US008850984B2

(12) United States Patent
Smylie et al.

(10) Patent No.: US 8,850,984 B2
(45) Date of Patent: Oct. 7, 2014

(54) DEVICE FOR IMPROVED METHOD OF BLASTING

(75) Inventors: Thomas Smylie, New South Wales (AU); Richard John Goodridge, New South Wales (AU); Deane Tunaley, New South Wales (AU); Steven Kotsonis, New South Wales (AU); Les Armstrong, New South Wales (AU); Brad Beikoff, Queensland (AU); Alexander Bilyk, Victoria (AU); Zang Xiaoqing, Victoria (AU); Long Yu, Victoria (AU); Dong Yang Wu, Victoria (AU)

(73) Assignees: Orica Explosives Technology Pty Ltd., Melbourne (AU); Commonwealth Scientific and Industrial Research Organisation, Campbell (AU)

( * ) Notice: Subject to any disclaimer, the term of this patent is extended or adjusted under 35 U.S.C. 154(b) by 688 days.

(21) Appl. No.: 12/865,712

(22) PCT Filed: Jan. 30, 2009

(86) PCT No.: PCT/AU2009/000102

§ 371 (c)(1),
(2), (4) Date: Mar. 16, 2011

(87) PCT Pub. No.: WO2009/094715

PCT Pub. Date: Aug. 6, 2009

(65) Prior Publication Data

US 2011/0155500 A1 Jun. 30, 2011

(30) Foreign Application Priority Data

Feb. 1, 2008 (AU) ..... 2008900466
Feb. 1, 2008 (AU) ..... 2008900468
Sep. 19, 2008 (AU) ..... 2008904899

(51) Int. Cl.

| | |
|---|---|
| ***F42D 5/04*** | (2006.01) |
| ***F42D 3/06*** | (2006.01) |
| ***A62D 3/35*** | (2007.01) |
| ***F42B 3/192*** | (2006.01) |
| ***F42C 15/44*** | (2006.01) |
| ***A62D 3/02*** | (2007.01) |
| ***A62D 3/38*** | (2007.01) |
| ***A62D 3/37*** | (2007.01) |
| *A62D 101/06* | (2007.01) |

(52) U.S. Cl.

CPC .. *F42D 5/04* (2013.01); *A62D 3/35* (2013.01); *F42B 3/192* (2013.01); *A62D 2101/06* (2013.01); *F42C 15/44* (2013.01); *A62D 3/02* (2013.01); *A62D 3/38* (2013.01); *C06B 21/0092* (2013.01); *A62D 3/37* (2013.01)

USPC ..... 102/314; 102/301; 102/313; 102/331; 86/50; 86/20.15; 299/13; 181/116

(58) Field of Classification Search

USPC ..... 102/301, 311, 312, 313, 314, 322, 331, 102/408, 426, 293; 181/101, 116; 86/50, 86/20.15; 299/13; 588/313, 403

See application file for complete search history.

(56) References Cited

U.S. PATENT DOCUMENTS

| | | | | |
|---|---|---|---|---|
| 3,322,066 | A * | 5/1967 | Griffith et al. | 102/318 |
| 3,948,177 | A * | 4/1976 | Fitch | 102/318 |
| 6,120,627 | A * | 9/2000 | Badger et al. | 149/108.8 |
| 6,644,200 | B1 * | 11/2003 | Badger et al. | 102/288 |
| 7,690,287 | B2 * | 4/2010 | Maegerlein et al. | 86/50 |
| 8,618,347 | B2 * | 12/2013 | Smylie et al. | 588/403 |
| 2011/0041718 | A1 * | 2/2011 | Lubbe et al. | 102/200 |
| 2011/0053255 | A1 * | 3/2011 | Smylie et al. | 435/262.5 |
| 2011/0124945 | A1 * | 5/2011 | Smylie et al. | 588/317 |
| 2011/0155500 | A1 * | 6/2011 | Smylie et al. | 181/116 |
| 2012/0282680 | A1 * | 11/2012 | Goodridge et al. | 435/262.5 |

FOREIGN PATENT DOCUMENTS

JP 2001-349700 A 12/2001

OTHER PUBLICATIONS

International Preliminary Report on Patentability received in connection with International Application No. PCT/AU2009/000102 (13 pgs.); dated May 21, 2010.
Supplemental European Search Report received in connection with European Patent Application No. 09705403.5 (3pgs.); dated Sep. 27, 2013.

* cited by examiner

*Primary Examiner* — James Bergin
(74) *Attorney, Agent, or Firm* — The Marbury Law Group, PLLC

(57) ABSTRACT

An explosive cartridge comprising:

an explosive composition;

a deactivating agent that is capable of desensitising the explosive composition; and a barrier element that prevents contact between the explosive composition and the deactivating agent and that is adapted to be at least partially removed on use of the explosive cartridge.

13 Claims, 13 Drawing Sheets

Petro AG. Time = 0

Time = 2 days

Teric GN8. Time = 0

Time = 5 days

DEVICE FOR IMPROVED METHOD OF BLASTING

The present invention relates to a cartridge that contains an explosive composition and that is adapted to achieve deactivation of the explosive composition in the event that it is not detonated as intended during use.

Explosives are used in a significant number of commercial applications, such as mining, quarrying and seismic exploration. In mining and quarrying a detonator is typically used to initiate a cartridged primer charge that in turn detonates bulk explosive. In seismic exploration a relatively small cartridged explosive charge is initiated using a detonator and the shock waves that are generated are monitored and analysed.

When a charge fails to detonate as intended there are obvious safety and security issues. In that event, it may be possible to recover the charge, although this is not always possible for a variety of reasons. For example, in seismic exploration where charges or trains of charges are positioned and detonated, recovery of undetonated charges can be difficult, especially when the charge(s) is/are positioned in an underground borehole and the borehole has been backfilled, as is common practice. There are therefore instances where undetonated charges remain unrecovered in the field. In such cases, and as a general point, it would therefore be desirable to render safe any undetonated and unrecovered explosive charges. A variety of approaches to address this need already exist.

By way of example, U.S. Pat. No. 3,948,177, describes an explosive cartridge for underwater blasting which is said to be self-disarming in the event of an underwater misfire. The cartridge comprises a closed shell including an internal conduit. Water external to the cartridge is prevented from flowing into the conduit by a watertight seal. The force of a percussion impact initiation can however break the watertight seal thereby allowing water to flow into the conduit and contact with explosive composition contained. In turn, water can dissolve the (nitrocarbonate) explosive possibly also causing it to flow out of the body of the cartridge. The result is desensitisation. Whilst generally useful, a problem with this approach is that desensitisation is contingent upon some form of specific force associated with a misfire to break the watertight seal. If there is no applied force resulting from a misfire, the cartridge would not be disarmed by the action of water.

The present invention seeks to provide an alternative approach to rendering safe explosive compositions that does not suffer the disadvantages described above.

Accordingly, in one embodiment, the present invention provides an explosive cartridge comprising:

- an explosive composition;
- a deactivating agent that is capable of desensitising the explosive composition; and
- a barrier element that prevents contact between the explosive composition and the deactivating agent and that is adapted to be at least partially removed on use of the explosive cartridge.

In accordance with the present invention, the action of a deactivating agent on the explosive composition is responsible for rendering the explosive composition insensitive to detonation, i.e. safe. Herein, unless otherwise evident, when it is indicated that an explosive composition is rendered insensitive to detonation means that the explosive composition has, by action of the deactivating agent, been desensitised at least to the extent that the normal (predetermined) method of initiation of the explosive composition is no longer effective. Thus, for an explosive composition that is known to be detonated using a particular type of initiating device, in accordance with the present invention the explosive charge is rendered insensitive to detonation if it is no longer possible for it to be initiated in that way. The fact that an explosive composition has been rendered insensitive to detonation does not mean that the explosive charge is completely undetonable (although this is of course a possibility). At the very least, the extent of desensitisation effected by the deactivating agent in accordance with the invention results in the explosive composition being insensitive to the initiation means that was otherwise and originally intended to cause detonation of the explosive composition.

In an embodiment of the present invention it may be desirable to employ two different deactivating agents (i.e. with different activities) to effect desensitisation of the explosive composition. In this case one of the desensitising agents acts to degrade the explosive composition to some by-product, with the other deactivating agent acting on the by-product. The latter deactivating agent has the effect of thermodynamically increasing the efficiency of the first deactivating agent due to degradation of the by-product associated with the deactivating activity of the first deactivating agent on the explosive composition. This embodiment may be implemented with more than two deactivating agents, as appropriate. In this embodiment at least one deactivating agent should be as required in accordance with the present invention. The other deactivating agent(s) may be of the same or different type.

Typically, the deactivating agent will itself cause suitable desensitisation of the explosive composition. However, it is also possible that desensitisation may be achieved through the combined activity of the deactivation agent and a reagent external to the explosive cartridge that will find its way or be introduced into the cartridge during use thereof and that can contribute to desensitisation of the explosive composition. Such reagents may be naturally present in the environment in which the explosive cartridge is to be used. In this embodiment the explosive cartridge will be adapted to allow the relevant reagent to be introduced into or enter the explosive cartridge as required.

In this case the relative order of activity of the deactivating agent and the another reagent is not especially critical. For example, the another reagent may degrade the explosive composition into a particular by-product that is then acted upon (degraded) by the deactivating agent, or vice versa. In this case the combined activity of the agent and reagent give a beneficial effect in terms of reaction thermodynamics.

Of course, the deactivating agent and another reagent may have the same general activity with respect to the explosive composition. In this case other reagents may be employed to enhance the thermodynamics of the relevant reaction(s) by consuming reaction(s) by-products.

By way of example, the explosive cartridge may be designed to allow environmental water to enter the body of the cartridge and contact the explosive composition, assuming of course that water has a desensitising effect of the emulsion. By way of further example, the cartridge may be adapted to allow ingress of microorganisms, for example water-borne microorganisms, that exist naturally in the environment in which the explosive cartridge is being used and that are capable of remediating the explosive composition contained in the cartridge. The cartridge may be provided with a nutrient source to promote uptake and proliferation of such microorganisms.

In the explosive cartridge of the present invention the deactivating agent and explosive composition are initially separated by a barrier element that prevents contact of their species. Central to the present invention is the use of a barrier element that is employed. Prior to use of the explosive cartridge, that is positioning and priming of the explosive cartridge, the barrier element prevents contact between the deactivation agent and explosive composition. In embodiments of the present invention the barrier element is breached or removed instantaneously when the explosive cartridge is being used in the field and here the deactivating agent does not render the explosive composition insensitive to detonation, or reduce significantly the energy output of the explosive composition, immediately. In other embodiments the barrier element remains in place between the deactivating agent and explosive composition when the explosive cartridge is actually positioned and primed but some mechanism for delayed removal of the barrier element is activated.

Typically, the external configuration of the explosive cartridge is cylindrical with the deactivating agent and explosive composition occupying respective chambers within the body of the cartridge. In this embodiment the explosive cartridge is sealed so that there is no risk of escape of components, for example, during storage and/or transportation. Sealing may be achieved by conventional techniques depending upon the materials used to form the cartridge. If the cartridge is formed from plastic, the body of the cartridge, including the respective chambers of it, may be formed by injection moulding with the chambers of the cartridge being loaded with the deactivating agent and explosive composition as required, with subsequent sealing (heat sealing, for example) in order to seal the inlets through which these components are supplied into respective chambers in the body of the cartridge. As an alternative, rather than relying on separate chambers that are integrally formed as parts of the cartridge structure, the deactivating agent and/or explosive composition may be provided in independent containers that are inserted into a rigid cartridge body. In this case it will be appreciated that the cartridge is made up of at least two independent parts and that in use the cartridge is assembled from those parts.

The material(s) used to form the cartridge of the invention should not be corroded by or be reactive towards the deactivating agent and explosive composition to be contained. Thus, the cartridge will retain its structural integrity.

In one embodiment of the invention the barrier element takes the form of an internal wall or internal wall portion (membrane) separating the chambers containing the deactivating agent and explosive composition. When this wall or wall portion is breached or removed the deactivating agent and explosive composition come into direct contact with each other. In accordance with the invention, this occurs only during use. Thus, in one embodiment the wall or wall portion may be ruptured by insertion of a detonator into the explosive cartridge (detonators are invariably used to initiate detonation), or by the act of connecting one cartridge to another to form a train of cartridges, as is common practice.

With respect to use of a detonator, the cartridge is usually adapted to receive the detonator in a suitably shaped passage extended axially within the body of the cartridge. In the embodiment described the barrier element may extend across this detonator-receiving passage such that, when the detonator is pushed into position in the cartridge, the wall originally separating the deactivating agent and explosive composition is ruptured thereby allowing these components to come into direct contact with each other. Alternatively, the action of inserting the detonator into the cartridge may cause a separate component to rupture the wall. This component may be a needle-like structure, rigid tube, or similar.

To achieve release of the deactivating agent when cartridges are coupled together in a train, the lower end of the cartridge may include a suitably shaped extension for insertion into the detonator-receiving passage of an adjacent cartridge (of the same design). Insertion of this extension into the detonator-receiving passage has the same effect as inserting a detonator in that the wall/membrane separating the deactivating agent and explosive composition is ruptured. Alternatively, the upper end of the cartridge may include a component that is adapted to be displaced downwardly (or upwardly) when the cartridges are coupled together and that causes the wall membrane to be ruptured. To facilitate attachment explosive cartridges in accordance with the present invention may also include suitable engagement or retaining means. For example, the lower end of the cartridge may include external threads with the upper end including corresponding internal threads thereby allowing adjacent cartridges to be secured to each other. It will be appreciated that the external shape of the lower end of the cartridge is adapted to mate with the upper end of an adjacent cartridge. In the particular embodiment described, the act of engaging and screwing cartridges together may cause rupture of the wall.

In another embodiment the deactivating agent and explosive composition may be provided in separate (sealed) components that are coupled only when the cartridge is to be used. Thus, the deactivating agent may be provided in a sealed cap that is adapted to be attached to a base cartridge portion including the explosive composition. The act of coupling the components together may cause release of the deactivating agent and this may be achieved along the lines already described. In this embodiment the cap containing the deactivating agent may need to be adapted to allow for a detonator to be inserted into the base cartridge portion. Additionally, a train of cartridges would need to be constructed with a cap containing the deactivating agent provided immediately above each base cartridge portion. Construction of a train of individual explosive charges may be more onerous in this embodiment when compared with embodiments where the deactivating agent and explosive composition are provided in a single (cartridge) structure.

Irrespective of which particular embodiment is employed, the integrity of the barrier element will only be compromised when the detonator is being used in the field. Prior to that point in time the barrier element is intended to remain intact thereby separating the deactivating agent and explosive composition.

In the embodiments described, when breach or removal of the barrier element is instantaneous, the deactivating agent and explosive composition will come into contact with each other straightaway. In this case the deactivating agent will start acting upon the explosive composition immediately. However, in such embodiments for the explosive cartridge to have a period of usefulness, it is important that the deactivating agent does not render the explosive composition insensitive to detonation, or reduce significantly the energy output of the explosive composition, immediately. If it did, the explosive cartridge would be useless, or of little practical use, as soon as the deactivating agent is released from the chamber containing it. It is instead intended that the deactivating agent desensitises the explosive composition after a suitable period of time and by this is meant a period of time after which detonation should otherwise have occurred. Thus, after release of the deactivating agent, the explosive cartridge may need to remain fully detonable (with the energetic output of the explosive composition unaffected or substantially unaffected) for a period of up to a few weeks, preferably for a period of up to a few (e.g. three to six) months. In some instances the explosive cartridge may be required to remain detonable (and useful) for a longer period, for example up to about twelve months. The reaction kinetics associated with the deactivating agent and explosive composition will dictate the rate of which the explosive composition is desensitised. In practice to achieve a useful product the reaction is relatively slow so that the transition between the explosive composition being detonable and non-detonable may be a relatively long one.

In other embodiments of the present invention the barrier element is adapted/designed to be breached or removed only after the explosive cartridge is used. In these embodiments removal/breach of the barrier element is not instantaneous on use of the cartridge, but rather some mechanism is activated that will lead to removal/breach of the barrier element after some predetermined period of time. Taking into account the activity of the deactivating agent this will invariably be a period of time after which desensitisation of the explosive composition is desired due to failure of the explosive cartridge to be detonated, as described above. The mechanism by which the barrier element is removed or breached may be chemical, electrical or mechanical in character.

In one such embodiment of the invention the barrier element comprises the type of wall/membrane described above but on removal, e.g. rupture, of that wall/membrane the deactivating agent remains separated from the explosive composition by a further wall/membrane formed from a material that is chemically degradable by the deactivating agent or a component thereof. In this embodiment when the first mentioned wall/membrane is breached the deactivating agent flows into a separate chamber, the walls of which are formed of the degradable material. The degradable material may be degraded by the active species of the deactivating agent that is responsible for desensitisation of the deactivating agent. However, this is not mandatory and the degradable material may be degraded by some other component specifically added to the deactivating agent for this purpose. Thus, the deactivation agent may take the form of a composition or mixture comprising a variety of functionally distinct components. In the following reference to the degradable material being degraded by the deactivating agent is intended to embrace these various possibilities.

In this embodiment the characteristics of the degradable material are very important. Thus, the material is selected so that it will be degraded after contact with the deactivating agent over a predetermined period of time, after which the material no longer retains sufficient integrity to prevent contact of the deactivating agent and explosive composition. Use of the degradable material in this way allows a deactivating agent to be employed that has the ability to rapidly desensitise an explosive composition when coming into contact with it. The degradable material is used to control when that contact occurs, although contact is inevitable after the deactivating agent has been released from the chamber in which it is originally present. It will be appreciated that prior to contact of the deactivating agent and explosive composition, the explosive cartridge remains useful with deactivation occurring only after a predetermined period of time before which the explosive cartridge should have been used. However, the fact that the deactivating agent is not released until the cartridge is actually being used means that the cartridge is storage stable.

In a variation of the embodiment described above the degradable material is degraded by a reagent that is external to the explosive cartridge. For example, environmental water is typically present in blastholes in which explosive cartridges and are used and the degradable material may be water-soluble so that on contact with environmental water degradation of the material commences. To facilitate this the explosive cartridge may include one or more inlets (apertures) or water-degradable pathways to allow environmental water to flow into the cartridge and into contact with the degradable material. In this embodiment the degradable material may define a cavity or cavities that separate(s) the deactivating agent and explosive composition with environmental water entering these cavities when the explosive cartridge is positioned.

As a further variation of this embodiment the reagent responsible for degrading the degradable material may be supplied into the explosive cartridge immediately prior to use. For example, an explosive cartridge could be suitably submerged in liquid reagent (e.g. water) prior to being positioned in a blasthole or the like, so that the reagent enters the explosive cartridge and into contact with the degradable material as desired. Reagent may also be delivered into the explosive cartridge through a feed line. Dependent upon the nature of the degradable material one potential advantage of this embodiment is that the characteristics (concentration, pH etc) of the reagent intended to degrade the degradable material can be tailored to achieve a predetermined degradation profile in the degradable material thereby permitting a further degree of control in implementation of the invention. The same is of course true when the reagent responsible for degradation of the degradable material is already present (stored) in the explosive cartridge prior to use.

It is also possible that the degradable material is degraded by a combination of the deactivating agent present in the explosive cartridge and by reagent supplied into the cartridge from an external source.

It will also be important that the degradable material that is used is not degraded (at least to a significant extent) by the explosive composition that will be present in the explosive cartridge of the invention. This is because the degradable material may be in constant contact with the explosive composition, whereas contact of the degradable material with the deactivating agent (or relevant component thereof) occurs only as a result of some deliberate action on use of the cartridge.

In these various embodiments, during use of the cartridge of the invention the deactivating agent is typically released into a chamber the walls of which (made of the degradable material) are in intimate contact with the explosive composition. This allows the deactivating agent to effect desensitisation thoroughly and rapidly once the separating wall of degradable material has been compromised. In one embodiment the chamber into which the deactivating agent will be released extends axially through the explosive composition so that the deactivating agent will contact the bulk of the explosive composition. This is preferable to the deactivating agent simply contacting a restricted surface area of the explosive composition. It is possible that the chamber into which the deactivating agent will be released has branches extending throughout the explosive composition in order to provide intimate contact between the deactivating agent and explosive composition, when that contact is required.

After initial release of the deactivating agent, the period of time before which the explosive composition in the cartridge becomes desensitised will depend on a number of factors. For example, the rate at which the deactivating agent (and/or other reagent if used) "consumes" the degradable material separating it from the explosive composition may be a significant factor. This can be determined experimentally for any combination of degradable material and/or reagent and deactivating agent. The thickness of the wall/membrane formed of the degradable material may be adjusted in order to provide greater control as to when the deactivating agent and explosive composition will come into contact with each other. It will be appreciated that the delay in contacting the deactivating agent and the explosive composition will give an operator sufficient time to otherwise use the explosive cartridge. Only if the explosive cartridge remains undetonated (due to some initiation failure) will the deactivating agent go on to contact the explosive composition to effect deactivation.

In other embodiments of the invention however the degradable material may not actually be in contact with the explosive composition. In such embodiments, when the degradable material is breached the deactivating agent flows into contact with the explosive composition, possibly through a non-degradable porous material that defines a deactivating agent receiving chamber adjacent and/or around the explosive composition and that allows instant contact between the deactivating agent and explosive composition when the deactivating agent is released into the chamber. The chamber may be configured as described above for the degradable material to achieve intimate contact between the deactivating agent and explosive composition. It is important that the porous material not be degraded by contact with the explosive composition. It is also important that the explosive composition does not impair the porosity of the material with respect to the deactivating agent, for example, due to hydrostatic pressure effects.

It will be appreciated that in certain embodiments of the invention the deactivating agent must be mobile (flowable) in order to achieve implementation of the invention. Thus, the deactivating agent is invariable used in the form of a liquid. As noted, the active species with respect to desensitisation of the explosive composition may be mixed with other components (assuming compatibility) to enable implementation of the invention.

In other embodiments of the invention the deactivating agent must be mobilised in order for contact with the explosive composition to take place. In this case the deactivating agent may be provided in any suitable form that is rendered mobile by water that enters or is delivered into the explosive cartridge when used. Thus, the deactivating agent may be provided in dehydrated or dried form such that contact with water results in formation of a solution or suspension of deactivating agent in water. Formation of the solution or suspension renders the deactivating agent mobile. The deactivating agent may also be provided as a gel or viscous liquid that itself is not suitably mobile but that when contacted with water becomes mobile. Herein reference is made to water being used as the vehicle that renders the deactivating agent mobile. Other liquid vehicles may of course be used. Water tends to be convenient as it is generally present in environmental in which the explosive cartridge will be used.

The mechanism by which the deactivating agent acts upon the degradable material is not especially critical, although it is obviously important that the deactivating agent remains suitably active to effect desensitisation of the explosive composition when coming into contact with it. By way of example, for a deactivating agent in the form of an aqueous solution, the degradable material may be a polymeric material that is susceptible to hydrolysis. Those experienced in the art will know that there are many examples of polymers that degrade by the action of water, and that there are ways of controlling the rate of polymer degradation and erosion. Polyesters are one type of hydrolytically degradable polymer, examples of which are polylactides, polyglycolides and polycaprolactones. Further examples of classes of hydrolytically degradable polymers are polyanhydrides, polyphosphazenes, and polyorthoesters. Naturally occurring polymers, such as starch or proteins or their modified derivatives, may also be a useful degradable barrier material. In general, any polymers which contain water-hydrolysable functional groups or whose structure is eroded by the action of water can also be used as a degradable barrier in this invention (when the deactivating agent is an aqueous solution).

Many methods can be used to control the rate at which these polymers are degraded or eroded by the action of water. For example, to speed up hydrolysis hydrophilic additives can be added to the polymer to increase water uptake. The hydrophilic additives can come in the form of, but not limited to, inorganic fillers, hydrophilic organic polymers, metal salts and surfactants. Acidic or basic additives could be used to speed up the rate of hydrolysis by acting as catalysts. Alternatively, the rate of hydrolysis can be slowed down by addition of hydrophobic additives or by blending with hydrophobic polymers. Increasing crystallinity of the polymer can also slow hydrolytic degradation with decreasing crystallinity having the opposite effect. There are many ways to control the degradation rate of a hydrolytically unstable polymer membrane useful for the present invention and many of these approaches and combinations of them can be used. The shape and/or thickness of the polymer may also be manipulated to influence the rate at which the deactivating agent will breach the membrane. These various issues may be investigated experimentally in order to optimise how the invention may be put into effect.

If the explosive composition is a water-in-oil emulsion this will include water (in the discontinuous or bound phase). However, this is unlikely to be in a form that will have a significant effect on the degradable material. However, if long storage times are required and the degradable membrane is affected by the water in the emulsion then a thin layer of a water barrier material can be applied to the side of the degradable membrane that will be exposed to the emulsion. This layer can be engineered so that it will crack when the degradable membrane begins to degrade. However, during storage and before use the layer will prevent reaction of water in the emulsion with the degradable membrane. It should also be noted that an emulsion explosive composition may be loaded into the cartridge at elevated temperature, as might be a consequence of manufacture of the composition. This should also be taken into account if the composition and degradable material will be in direct contact with each other in the cartridge.

In another embodiment the controlled deactivating agent release membrane may be a multilayer system comprised of a barrier layer that is bonded to a layer that swells when exposed to the deactivating agent. The action of swelling will lead to the barrier layer rupturing/fracturing, thereby releasing the deactivating agent. Other layers can be added. For example, a degradable layer may be added over the layer that swells in order to control the timing of swelling. In this case the action of water or other component in the deactivating agent formulation will need to degrade the degradable layer to some extent before the adjacent layer swells and causes cracking of the multilayer membrane. To further control the timing of deactivating agent release the layer that swells may also be degradable so that it needs to degrade partially before it can adsorb sufficient water or other component of the deactivating agent and cause fracturing of the multilayer membrane. It may also be possible that the swellable layer be sandwiched between two layers, one that is a barrier and the other that is a porous layer. If the porous layer is far stiffer than the barrier layer, then swelling of the swellable layer will lead to fracture of the barrier layer and release of the deactivating agent. The spirit of the invention includes the use of such multilayer membrane systems to control the release of the deactivating agent. The multilayer system may be made up of combinations of the materials types that have been mentioned, although other materials may also be useful in this regard. The behaviour of a multilayer membrane can be examined experimentally leading to optimised design.

As a slight variant, and as mentioned above, breach of the wall/membrane may allow the deactivating agent to flow into a channel defined by a material that has structural rigidity and that is porous to the deactivating agent. When the deactivating agent is released into this channel it will migrate through the material thereby coming into contact with the explosive composition. The rate of this migration will obviously determine when these two components come into contact, and it may be possible to manipulate this rate as might be required. When the deactivating agent is an aqueous solution, this channel may be defined by cardboard or the like. A cardboard tube may, for example, be used to define the channel. Other porous materials may be used with pore size, specific chemical functionality, specific surface texturing or any combination of these being varied to control the rate of transmission of the deactivating agent. It is also possible to use a membrane system that combines degradation and controlled release of the deactivating agent through the degraded membrane. Those experienced in the art of controlled transport of chemical species across porous membranes will know that there are many materials choices which may be useful in practice of this aspect of the invention.

The rate at which the explosive composition will become desensitised will depend upon the kinetics of reaction between the deactivating agent and explosive composition and/or the extent to which the deactivating agent and explosive composition come into contact with each other. As noted above, it is believed that the deactivating agent will have a more rapid desensitising effect on an explosive composition when introduced into the bulk of the composition. These factors can also be determined experimentally.

In another embodiment of the invention the mechanism that is activated to cause breach/removal of the barrier element is mechanical in nature. In a specific example of this embodiment the barrier element takes the form of flexible membrane attached to a support member, the support member being resiliently extendable between a retracted position in which the flexible membrane does not prevent contact between the deactivating agent and the explosive composition and an extended position in which the flexible membrane prevents contact between the deactivation agent and the explosive composition. One end of the support member is attached to an internal wall of the explosive cartridge and the other end of the support member is attached in the extended position to a release mechanism, wherein the release mechanism prevents movement of the support member between extended and retracted positions for a predetermined period of time.

In this particular embodiment the support member is attached in the extended position to a release mechanism. Due to the resilient nature of the support member this attachment results in the application of a force on the release mechanism and after a predetermined period of time this force results in activation of the release mechanism so that the end of the support member attached to the release mechanism is released thereby allowing the support member to return to the retracted position. As the flexible membrane is attached to the support member, this will also mean that the flexible membrane will retract. In turn this allows deactivating agent previously separated from the explosive composition to be released and to contact the explosive composition.

The release mechanism is designed/adapted to allow the support member to move between extended and retracted positions after a predetermined period of time. Taking into account the activity of the deactivation agent, this will be a period of time after which desensitisation of the explosive composition is desired following detonator failure of the explosive cartridge. This embodiment is therefore somewhat similar to the embodiments described above in which contact of the deactivating agent and explosive composition are intentionally delayed.

The flexible membrane may take the form of an elongate impermeable (rubber or plastic) sheath in which deactivating agent may be housed. The support member may conveniently take the form of an elongate helical spring to which the sheath is suitably attached along the axis of the spring. The spring may be provided internally or externally relative to the sheath. The sheath is typically sealed at its lower end (the end attached to an internal wall of the cartridge) and open at the other end (the end closest to the release mechanism). The open end of the sheath will usually be sealed by a cap that includes one or more apertures through which deactivating agent may be released when the support member moves between extended and retracted positions. When the support member is in the extended position the one or more apertures are sealed by corresponding structural features. The latter may take the form of a rubber O-ring or gasket that is displaced as the support member moves between extended and retracted positions thereby opening the one or more apertures to release deactivating agent. Once released the deactivation agent will come into contact with the explosive composition.

It its initial (unused) state the support member is in an extended position so that the flexible membrane prevents contact between the deactivation agent and the explosive composition. Sine the support member is resilient it exerts a withdrawing force against the release mechanism to which it is attached.

In one embodiment the release mechanism comprises a creep member to which one end of the support member is attached either directly or indirectly. The creep member is a length of material that has been selected based on its creep properties, that is the plastic deformation properties of the material. In accordance with the invention the withdrawing force exerted by the support member is applied to the creep member thereby causing plastic deformation of the creep member. When this plastic deformation reaches a particular (and predetermined) amount release mechanism causes the end of the support member to be suddenly released so that the support member reverts to the retracted position. As will be appreciated this causes the flexible membrane to collapse and the deactivation agent to be released for contact with the explosive composition.

The release mechanism is designed to achieve the release of the support member when the creep member has undergone a predetermined amount of creep. The end of the support member, or more likely the cap provided over the end of the flexible membrane (to prevent escape of deactivation agent), may be attached directly to the creep membrane and in this case the ends of the creep member may be located at anchor points in the release mechanism or provided on internal walls of the explosive cartridge such that the predetermined amount of creep in the creep member will cause downward deflection of the creep member and release of the ends of the creep member from at least one of the anchor points. In turn this allows the support member and associated flexible membrane to retract rapidly thereby releasing deactivating agent.

In a preferred embodiment the support member is attached indirectly to the creep member. In this case the cap provided at the end of the support member may be adapted to be releasably received by a corresponding fitting that is attached to or in contact with the creep member. It is intended that the cap will be released from the fitting only after the creep member has undergone a particular amount of creep (deflection). For example, the fitting may comprise (hinged) retaining arms that grip the cap and that have the ability to splay out when the cap/fitting assembly have been withdrawn a particular distance by the support member as the creep member deforms under load from the support member. The retaining arms may be prevented from splaying outwardly and thus releasing the cap until this distance has been travelled by the configuration of internal walls provided in the release mechanism or cartridge. When the creep member has been deformed to a sufficient (predetermined) extent and the cap/fitting assembly has been withdrawn the corresponding distance, the retaining arms are allowed to splay out thereby releasing the cap and enabling the support member to return to the retracted position. This will cause release of the deactivating agent.

In the extended position the support member will always exert a withdrawing force against the creep member. However, to prevent the onset of creep in the creep member before use of the explosive cartridge, the cap or corresponding fitting may be held in place by a suitably designed locking mechanism that is released when the explosive cartridge is to be used. In one embodiment the locking mechanism takes the form of a sliding member that otherwise covers a detonator receiving passage provided in the explosive composition of the cartridge. The act of moving the sliding member to reveal the detonator receiving passage, as would take place during use of the cartridge as a detonator is loaded into it, also has the effect of releasing the cap or fitting so that creep of the creep member is commenced under load of the support member. The sliding member may also be adapted to retain or guide detonator wires associated with the detonator after the sliding member has been moved to allow placement of the detonator in the cartridge.

In an embodiment of the invention the explosive cartridge of the invention includes another deactivating agent in addition to the deactivating agent that is separated from the explosive composition by the barrier element. The another deactivating agent may be of the same or different type as the deactivating agent otherwise used in the explosive cartridge. This another deactivating agent may be provided separate to the explosive composition and must be mobilised in order for contact with the explosive composition to take place. In this case the another deactivating agent may be provided in dehydrated/dried form and is hydrated and made mobile by water that enters or is delivered into the explosive cartridge when used. Water solubilises the another deactivating agent rendering it mobile. A water-permeable membrane may be used to separate the explosive composition and dehydrated deactivating agent with the deactivating agent permeating this membrane when mobilised by contact with water. It may also be possible to implement this embodiment using a water-degradable membrane to separate the explosive composition and dehydrated deactivating agent. It is important that the membrane that is used is not degraded by the explosive composition.

In this embodiment the explosive cartridge may include one or more inlets (apertures) or water-degradable pathways to allow environmental water to flow into the cartridge and into contact with the (dehydrated) deactivating agent. The membrane may define a cavity or cavities that separate(s) the (dehydrated) deactivating agent and explosive composition with environmental water entering these cavities when the explosive cartridge is used. As a further variation of this embodiment water may be supplied into the explosive cartridge immediately prior to use. For example, an explosive cartridge could be suitably submerged in water prior to being positioned in a blasthole or the like, so that the water enters the explosive cartridge as desired. Water may also be delivered into the explosive cartridge through a feed line.

In a further embodiment the another deactivating agent may be provided in contact with the explosive composition, for example the deactivating agent may be distributed through the bulk of the explosive composition. In this embodiment the another deactivating agent may be encapsulated or provided in pelletised or granulated form, or the like. This general approach is known in the art in relation to the use of microorganisms as deactivating agent, for example from U.S. Pat. No. 6,334,395 and U.S. Pat. No. 6,668,725.

This embodiment also relies on the need for the another deactivating agent to be in contact with water so that it is in a form that will effect desensitisation and/or so that it is in a form suitably mobile to effect desensitisation. As noted above the explosive cartridge may include one or more inlets or water-degradable pathways to allow the introduction of water into the body of the cartridge. Water may be conveyed to, and possibly through the bulk of, the explosive composition by use of a suitably designed water-permeable or water-degradable membrane.

In an embodiment of the present invention the explosive composition may be deactivated by the combined activity of the deactivating agent (that is separated from the explosive composition by the barrier element) as described herein and an additional deactivating agent that enters the explosive cartridge during use thereof. For example, the additional deactivating agent may be at least one microorganism that is present in the environment in which the explosive cartridge is being used and that is capable of acting on the explosive composition in order to convert it into by-products that are at least less detonable, and preferably non-detonable, when compared with the explosive composition in its original form in the explosive cartridge. In an embodiment of the invention the additional deactivating agent acts on the explosive composition to render it more environmentally friendly (non-toxic), as might be useful in practice.

In this embodiment the at least one microorganism may be carried into the explosive cartridge in water present in the surroundings in which the cartridge is positioned (blastholes are typically wet environments). The cartridge may be designed to include apertures or inlets to allow ingress of environmental water, and thus microorganisms, into the body of the cartridge and into contact with the explosive composition. Channels may be provided in and/or around the explosive composition to ensure a suitably high surface area of contact between incoming water/microorganisms and the explosive composition.

In one embodiment the cartridge may include a water-permeable or water-degradable outer shell (membrane) surrounding the explosive composition, possibly with channels or passages extending into the explosive composition. In use water permeates or degrades the shell (and channels/passages when present) thereby allowing the water and microorganisms to come into contact with the explosive composition. At that time the microorganisms begin to act on the explosive composition as intended.

In another related embodiment the cartridge includes a shell and optionally channels/passages formed of a material that will be dissolved by water and/or consumed by microorganisms present in the environment in which the cartridge is used. In this embodiment the microorganisms also have the ability to act on the explosive composition as described above. Desirably the microorganisms have a greater affinity for the material of the shell (and where present channels/passages) so that once the material is breached the microorganism acts preferentially on the explosive composition.

In these embodiments the time taken for the microorganism to come into contact with the explosive composition and the rate at which the microorganism acts on the explosive composition as desired (under prevailing conditions of use) is such that deactivation of the cartridge will not be achieved until a predetermined amount of time has elapsed, prior to which the cartridge would normally have been detonated.

In another embodiment the deactivating agent may be coated with a barrier element that is water-degradable or water-soluble. In this embodiment it is intended that on use of the cartridge water will enter the cartridge, via one or more mechanisms described herein, and dissolve or degrade the barrier element thereby rendering active the deactivating agent. In this case the deactivating agent may take the form of particles coated with a suitable barrier element. By way of example, the deactivating agent may be iron powder.

In a slight variation of this the deactivating agent may require another agent in order to be active with this other agent being released for contact with the deactivation agent in accordance with the embodiments of the invention. For example, iron in dry form has some degrading effect on PETN and TNT but this effect is dramatically increased when the iron is in an aqueous (wet) environment. In this case removal of the barrier element results in contact of a reagent with the deactivating agent, and wherein the reagent renders the deactivating active or potentiates the activating of the deactivating agent with respect to the explosive composition.

In both of these latter embodiments the deactivating agent may be distributed throughout the explosive composition.

The explosive composition used in the explosive cartridge of the invention is conventional in nature and will be selected based on its ability to be desensitised by the deactivation agent or agents to be used. Examples of explosive materials that may be considered for use in the present invention include trinitrotoluene (TNT), pentaerythritol tetranitrate (PETN), cyclotrimethylene trinitramine (RDX) and cyclotetramethylene tetranitramine (HMX). The explosive composition may be an emulsion explosive, a water-gel explosive composition or an ANFO or other nitrate-based composition. Other less conventional explosives may also be used such as liquid or gel compositions which are aqueous or non-aqueous and possibly containing other explosive components such as perchlorates. Combinations of explosive materials may also be used. For example, the explosive composition may be Pentolite, a mixture of PETN and TNT.

In one embodiment of the present invention the explosive composition may be a water-in-oil emulsion. Emulsion explosive compositions typically includes a discontinuous phase comprising a supersaturated aqueous solution of an oxidiser salt (usually ammonium nitrate) dispersed in a continuous oil (fuel) phase. Such emulsions are usually formed by mixing the components in the presence of a suitable emulsifier. In the context of emulsion explosive compositions, the deactivating agent may include any reagent that is capable of breaking or rendering unstable the emulsion, thereby causing it to be insensitive to detonation. Usually, the deactivating agent will have the effect of causing crystallisation of the supersaturated emulsion component (the oxidiser salt in the type of emulsions described). Accordingly, one skilled in the art may select suitable reagents for use as deactivating agent, at least for initial screening, based on a general knowledge of emulsion chemistry and of reagents that are known to cause unwanted crystallisation of (supersaturated) emulsion explosive compositions. Here it is important to note that the present invention seeks to make positive use of reagents that might previously have been regarded as being detrimental in the context of emulsion explosive compositions. The type of deactivating agent used will usually be selected on the basis of the emulsion explosive composition being used rather than vice versa.

The present invention has particular utility in seismic survey applications and in this case the explosive cartridge takes the form of a seismic charge. One skilled in the art will be familiar with the type of explosives in this context In an embodiment of the present invention the deactivating agent is a chemical. In this context the term "chemical" refers to a non-biological reagent that is capable of desensitising the explosive composition in order to render it insensitive to detonation. The exact mechanism by which this is achieved is not believed to be critical. The deactivating agent may cause structural changes in the explosive composition leading to a reduction or loss of detonation sensitivity. The deactivating agent may vary as between different types of explosive composition and as between different formulations of the same type of explosive composition. The effectiveness of a deactivating agent with respect to any given explosive composition may be determined experimentally.

It will be appreciated from this definition that the chemical does not embrace biological-based deactivating agents as will be described below. It will also be appreciated that the effect of the chemical with respect to the explosive composition is more than as a simple solvent, although it is possible that the chemical poison may have the effect of dissolving one or more components of the explosive composition. It will be noted that in U.S. Pat. No. 3,948,177 deactivation of the explosive charge results due to dissolution of the explosive charge and, possibly due to the explosive charge being carried out of the explosive cartridge as a result of dissolution. It is to be appreciated that the use of water (alone) as chemical poison is not within the context of the present invention. Under the conditions of intended use the chemical is usually a liquid.

Chemicals useful in the present invention for remediating explosives are known in the art. For example, it is known that TNT, RDX and HMX may be remediated in contaminated soil by alkaline hydrolysis using suitable chemical reagents. It is also known to remediate RDX-contaminated soil using zero-valent iron. It is also known to degrade nitro-containing explosives such as TNT, RDX, HMX and PETN by contact with a solution comprising a superoxide salt, such as potassium superoxide and sodium superoxide. Useful chemicals for any given explosives material may be determined experimentally. The examples included in the present specification describe this and identify chemical poisons that may be used to desensitise water-in-oil emulsion explosive compositions.

In an embodiment of the present invention the deactivating agent relies on the use of one or more types of microorganism to desensitise the explosive composition by degrading the explosive composition into less explosive materials or non-explosive materials. The microorganisms may further comprise a type of microorganism that further bioremediates any intermediate chemicals resulting from the bioremediation action of the first type of microorganisms to fully bioremediate the explosive material into non-explosive materials.

Any type of microorganism capable of desensitising explosive material is considered to be useful within the context of the present invention. Examples of microorganisms that are known to exhibit that ability include *Pseudomonas* spp., *Escherichia coli, Morganella morganii, Rhodococcus* spp., *Comamanos* spp., and denitrifying bacteria. Suitable *Pseudomonas* spp. microorganisms include microorganisms in the group *aeruginosa, fluorescens, acidovorans, mendocina, cepacia.*

The present invention may utilise any of numerous different selections of microorganisms capable of degrading explosive materials in any of various relative quantities. Each of these various selections of microorganisms will hereinafter be referred to as a "microorganism consortium". In such a microorganism consortium, one type of microorganism can advantageously reduce the explosive material to a particular intermediate chemical, while that type or another type of microorganism may further the reduce the benzene to carbon chains or to individual carbon atoms. In one embodiment, a microorganism consortium may be utilised based on various of the microorganisms belonging to *Pseudomonas* spp., *Escherichia coli, Morganella morganii, Rhodococcus* spp., *comamonas* spp., and denitrifying bacteria.

The microorganism(s) used in accordance with this embodiment must be viable under the conditions of intended use. If aerobic microorganisms are being used it will obviously be necessary for oxygen to be available to the microorganism(s). It may also be necessary to provide nutrients for the microorganism in order for the microorganism to function as intended to desensitise explosive material. One skilled in the art would be aware of such things.

The microorganism may be provided in the explosive cartridge in a ready to use form so that upon contact with the explosive composition the microorganism commences desensitisation of the explosive composition by degradation of it. In an embodiment of the invention the microorganism(s) are provided in dehydrated form and must be hydrated before they exhibit the request activity. Hydration may take place using water when the barrier element in the explosive cartridge is at least partially removed, as described.

As well as deactivating the explosive composition, desirably the deactivating agent also converts the explosive composition (or components thereof) into one or more compounds that are more environmentally acceptable.

A combination of the same or different type of deactivating agents may be used in practice of the present invention.

The present invention also relates to a blasting system that comprises an explosive cartridge in accordance with the present invention, and to the use of such explosive cartridge in a blasting operation. As has been explained, the present invention is likely to find particular utility in the context of seismic exploration.

Embodiments of the present invention are illustrated in the accompanying non-limiting figures, in which.

Figure 1:
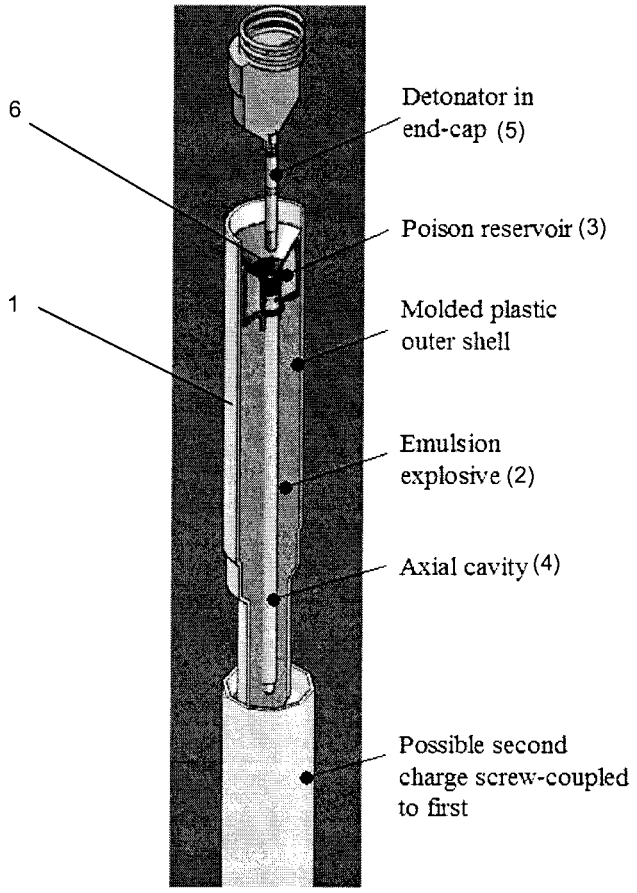
FIGS. 1-3 shows a cross-section of explosive cartridges in accordance with the present invention, with FIGS. 2 and 3 illustrating the same design.

Thus, FIG. 1 shows an explosive cartridge (1) suitable for use in seismic exploration. The explosive composition and deactivating agent remain sealed in their respective chambers (2, 3). Therefore, subject to the stability of the emulsion explosive composition, the cartridge (1) is a storage stable product.

The cartridge also includes a small diameter axial channel (4) extending down within the body of the cartridge (1) from the deactivating agent chamber (3) through the explosive composition. This channel (4) is defined by a wall formed from a polymeric material that is degradable on contact with the deactivating agent. In the arrangement shown in FIG. 1 the channel (4) is empty since the deactivating agent has not been released from the chamber (3). A seal (not shown in detail) is provided between the deactivating agent chamber (3) and the channel (4), this seal being designed so that breakage of it will cause release of deactivating agent from chamber (3) into channel (4) extending through the explosive composition.

The upper end of the cartridge (1) is adapted to receive a cylindrical detonator (5). When the cartridge (1) is to be used in the field, this detonator (5) is inserted into a detonator-receiving channel (6) extending into the body of the cartridge (1). In the embodiment shown the detonator-receiving channel (6) is provided as an extension of the channel (4). The action of inserting the detonator into the detonator-receiving channel (6) causes the seal between the deactivating agent chamber (3) and the channel (4) to be broken thereby releasing deactivating agent into the channel (4). However, contact between the deactivating agent and the explosive composition is prevented by the walls of the channel (4) and the deactivating agent must first penetrate these walls before contacting explosive composition.

Although not shown, it may be necessary for the design to include some kind of air inlet (or breather tube) to allow air into the deactivating agent chamber (3) as deactivating agent flows out. In the absence of an air inlet, flow of deactivating agent may be restricted. Generally, air will only be allowed into the deactivating agent chamber (3) when the cartridge is being used, thereby preventing leakage of the deactivating agent.

Surface tension effects of the deactivating agent may also influence design or the characteristics of the deactivating agent to be used. Although also not shown it may be useful to allow the deactivating agent once released to come into contact with a wick or open cell foam that extends down into the channel (4) and that has the effect of conducting/drawing deactivating agent down into the channel (4).

The walls of the channel (4) are made of a degradable (polymeric) material that may be hydrolysed by water present in the aqueous deactivating agent. On contact of the deactivating agent and the walls of the channel (4) the deactivating agent therefore (slowly) degrades the walls. Whilst the walls remain intact no contact of the deactivating agent and explosive composition takes place and this delay allows a user of the cartridge (1) sufficient time to load the cartridge into a blasthole and attempt detonation of the cartridge (1) as intended. Thus, the functionality of the cartridge (1) remains intact even though the deactivating agent has been released from the chamber (3) originally containing it.

After a predetermined period of time (usually selected to be a number of months) the walls of the channel (4) will have been dissolved/consumed/weakened by the deactivating agent. The integrity of the walls is therefore lost and the deactivating agent comes into contact with the explosive composition. The deactivating agent then causes crystallisation of the emulsion explosive composition thereby rendering it safe. Tests in a typical chart configuration (10 mm diameter cavity in a 57 mm diameter charge) indicate that a commercially available seismic emulsion explosive (Magnagel™; Orica) can become insensitive to a No. 8 detonator 1 g PETN based charge within a month of exposure to a deactivating agent (Petra AG Special Liquid; Akzo Nobel).

Although not shown in FIG. 1 the lower end of the cartridge (1) may also be shaped in order to be inserted into the detonator-receiving channel of an adjacent cartridge. Thus, forming like cartridges into a train of cartridges can also result in release of deactivating agent from the chamber (3) in which it is originally contained. The upper and lower ends of the cartridge (1) may also contain cooperating features, such as screw threads, to enable cartridges to be secured together.

In the embodiment described when released the deactivating agent flows into channel (4) running essentially the entire length of the explosive composition included in the cartridge (1). This is a preferred arrangement and the volume of the cavity is configured to be such that in use it will contain sufficient deactivating agent to deactivate the entirety of the explosive composition (over time). After the wall of the channel (4) has been broken down by action of the deactivating agent, explosive composition adjacent to the deactivating agent and thus adjacent to the detonator when positioned in the cartridge will be first exposed to the deactivating agent. This region of the explosive composition therefore comes into contact with the highest concentration of deactivating agent thereby promoting the fastest and most effective deactivation of the explosive composition. Other arrangements are of course possible.

In an alternative arrangement the deactivating agent flows into an annular cavity provided in the outer periphery of the cartridge body. In this embodiment it will be appreciated that the degradable material is provided on the outer surface of the emulsion preventing contact between the explosive composition and the deactivating agent (when released). When the material is degraded by the deactivating agent, the deactivating agent will contact outer regions of the explosive charge first. However, assuming the cartridge is used with a detonator in a central detonator-receiving passage, this embodiment suffers the potential drawback that explosive composition far removed from the location of the detonator will be deactivating agented first. There is therefore a greater risk of failure to deactivate the explosive composition if the deactivating agent action does not penetrate radially into the explosive composition (towards the location of the detonator). This embodiment does however have the advantage of a high surface area of contact between the deactivating agent and explosive composition.

As a further alternative, the deactivating agent may flow into a cavity provided over the top of the body of explosive composition provided in the cartridge. However, this embodiment suffers the potential disadvantage of low surface area of contact between the deactivating agent and explosive composition and this can lead to slow and/or incomplete deactivation of the explosive composition. Other alternatives are of course possible within the context of the present invention.

Figure 2:
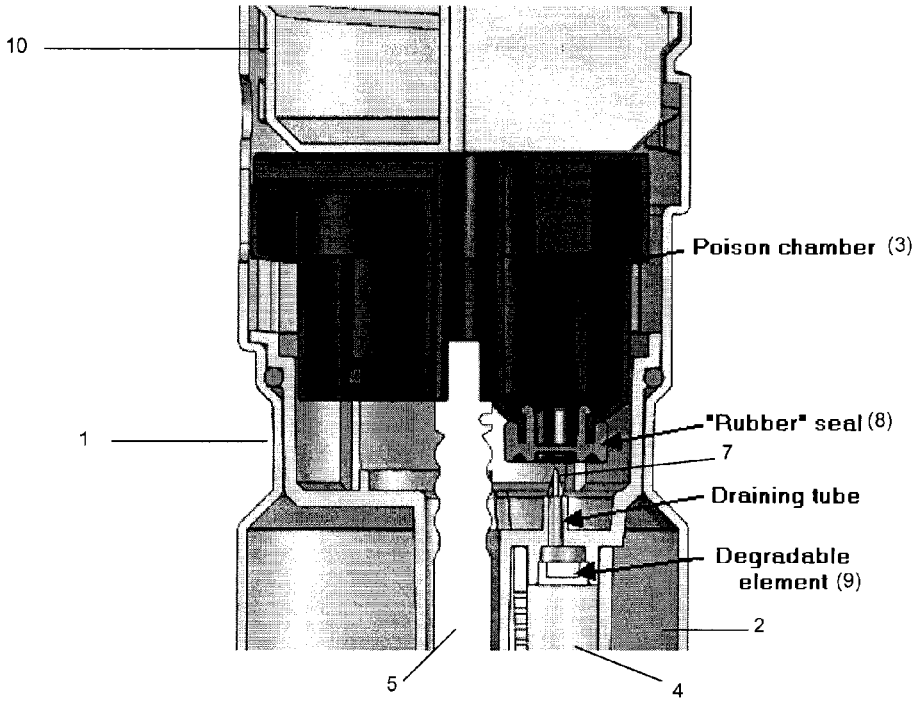
Figure 3:
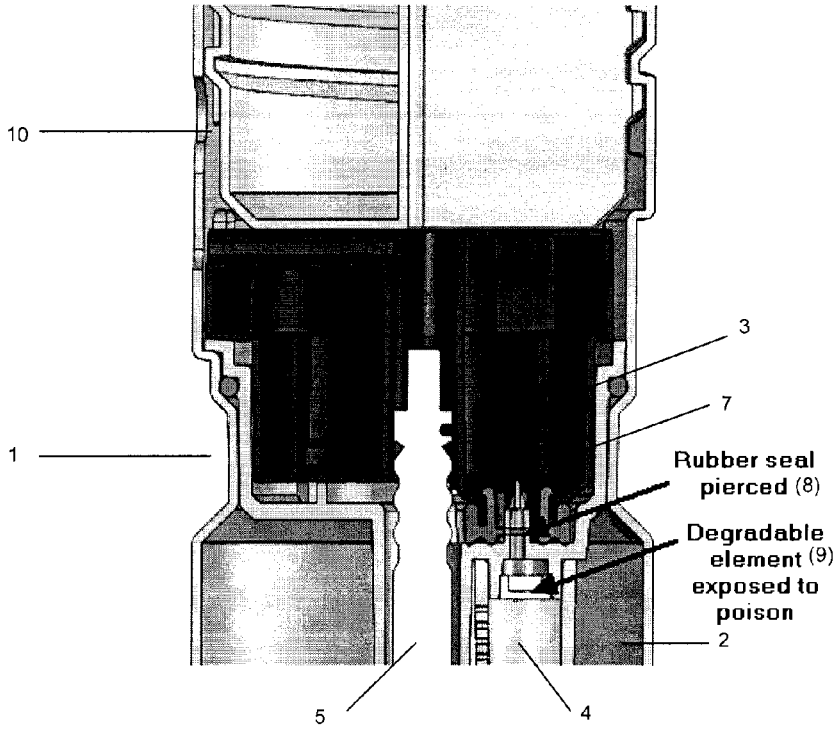

FIGS. 2 and 3 illustrate another embodiment of the present invention. FIG. 2 illustrates an arrangement before release of the deactivating agent and FIG. 3 an arrangement when the deactivating agent is released. The Figures show an exploded view of only a portion of the cartridge.

FIGS. 2 and 3 show an explosive cartridge (1) in the form of an elongate cylinder made of a suitably rigid plastic. The cartridge includes a sealed chamber (2) containing an explosive composition and a further sealed chamber (3) containing a deactivating agent. During storage and transport of the cartridge (1) the deactivating agent and explosive composition remain sealed in their respective chamber (2,3).

The cartridge (1) also includes a small diameter axial channel (4) extending down within the body of the cartridge (1) from the deactivating agent chamber (3) through the explosive composition. This channel is provided off-centre and is distinct from the channel into which a detonator (5) is provided. The walls of the channel (4) may be formed of a porous material that in use will allow deactivating agent to be communicated to the explosive composition and that has sufficient structural rigidity to define a channel adjacent or through the explosive composition.

At the top (entrance) to the channel (4) there is an arrangement that is designed to cause release of deactivating agent from chamber (3) into the channel (4) when the cartridge (1) is to be used. This arrangement includes an elongate element (7) projecting upwardly from the top of the channel (4). This element (7) may be a tube that is adapted at one end to pierce a correspondingly located (rubber) seal (8) provided on the lower end of the deactivating agent chamber (3). The element (7) communicates at its lower end with a seal (9) provided over the entrance to the channel (4). This seal (9) is made of a material that is degradable on contact with the deactivating agent.

Prior to use the seal (8) is in tact and the seal (8) and element (7) are in close proximity to each other. This arrangement is shown in FIG. 2. In use of the cartridge, the deactivating agent chamber (3) is displaced downwards relative to the element (7) and this occurs as a result of engagement of the upper end of the cartridge (1) with an engagement member (10). In the embodiment shown the inner surface of the upper end of the cartridge (1) includes screw threads adapted to engage corresponding screw threads provided on the outer surface of the engagement member (10). The member (10) may be a specially designed cartridge cap or the lower end of another cartridge (1). The action of screwing the member (10) into the top of the cartridge (1) causes the deactivating agent chamber (3) to be displaced downwards. In turn this causes the piercing element (7) to pierce the (rubber) seal (8). Deactivating agent then flows down through the element (7) thereby coming into contact with the degradable seal (9). This is shown in FIG. 3. As already noted, an air inlet or breather tube may be required to ensure flow of the deactivating agent, and surface tension effects may need to be taken into account too. Preferably, the air inlet/breather tube is "activated" only when the member (10) is screwed into the top of the cartridge (1) in order to release the deactivating agent. This prevents leakage of deactivating agent prior to use.

After a predetermined period of time the seal (9) will be dissolved/consumed/weakened by the action of the deactivating agent. The integrity of the seal is lost thereby allowing deactivating agent to drain into the channel (4). The deactivating agent then flows through the porous/permeable walls of the channel and into contact with the explosive composition. The deactivating agent goes on to desensitise the explosive composition thereby rendering it safe.

Figure 11:
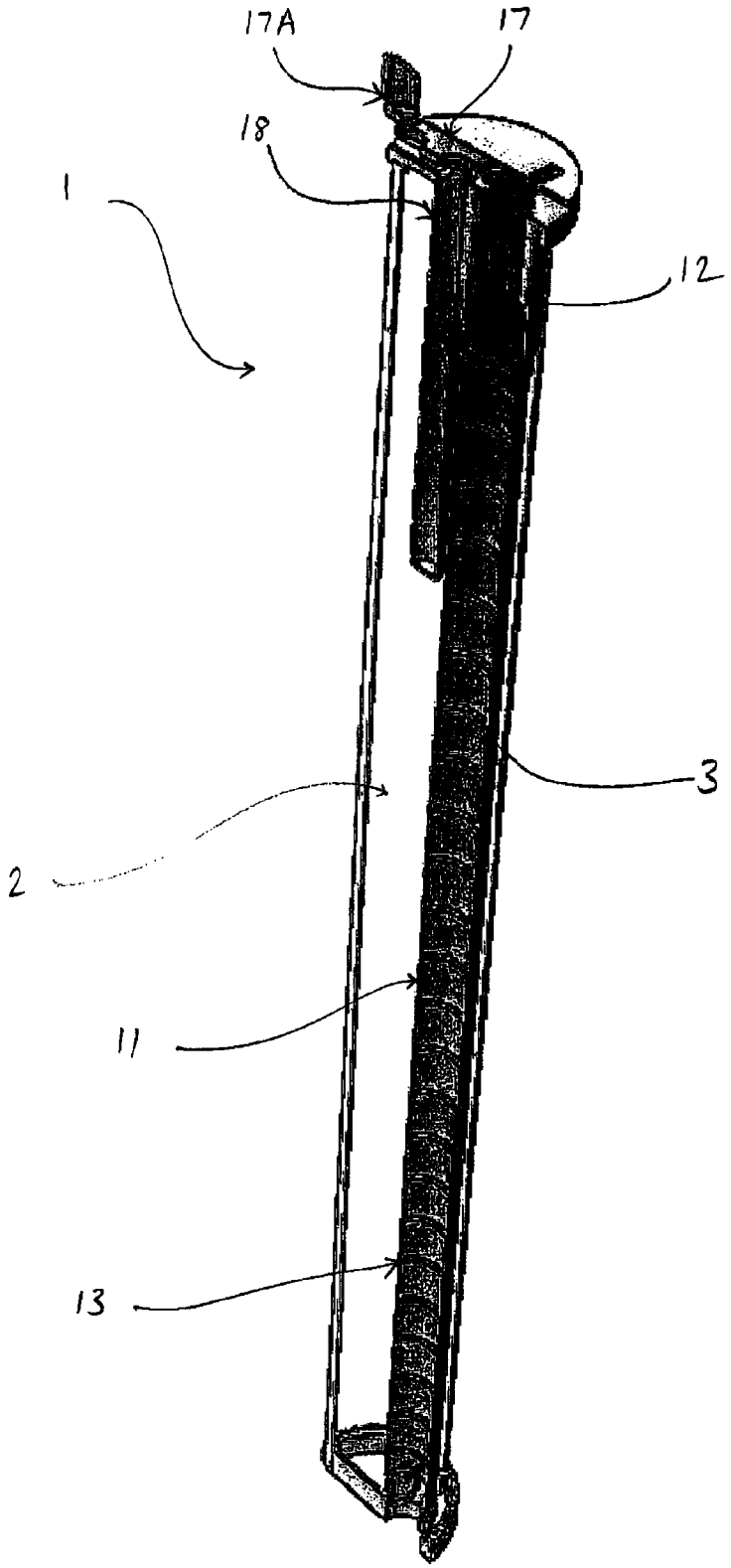
FIGS. 11-15 are cross-sections of an explosive cartridge in accordance with the present invention. These figures represent various cross-sectional views of the same explosive cartridge.

FIG. 11 shows an explosive cartridge (1) suitable for use in seismic exploration. The explosive composition and deactivating agent remain sealed in their respective chambers (2, 3). The deactivation agent is confined by a flexible membrane that is in the form of an elongate plastic or rubber sheath (11). The sheath (11) is closed at one end at the base of the cartridge (1) and sealed at the other end by a cap (12).

Figure 12:
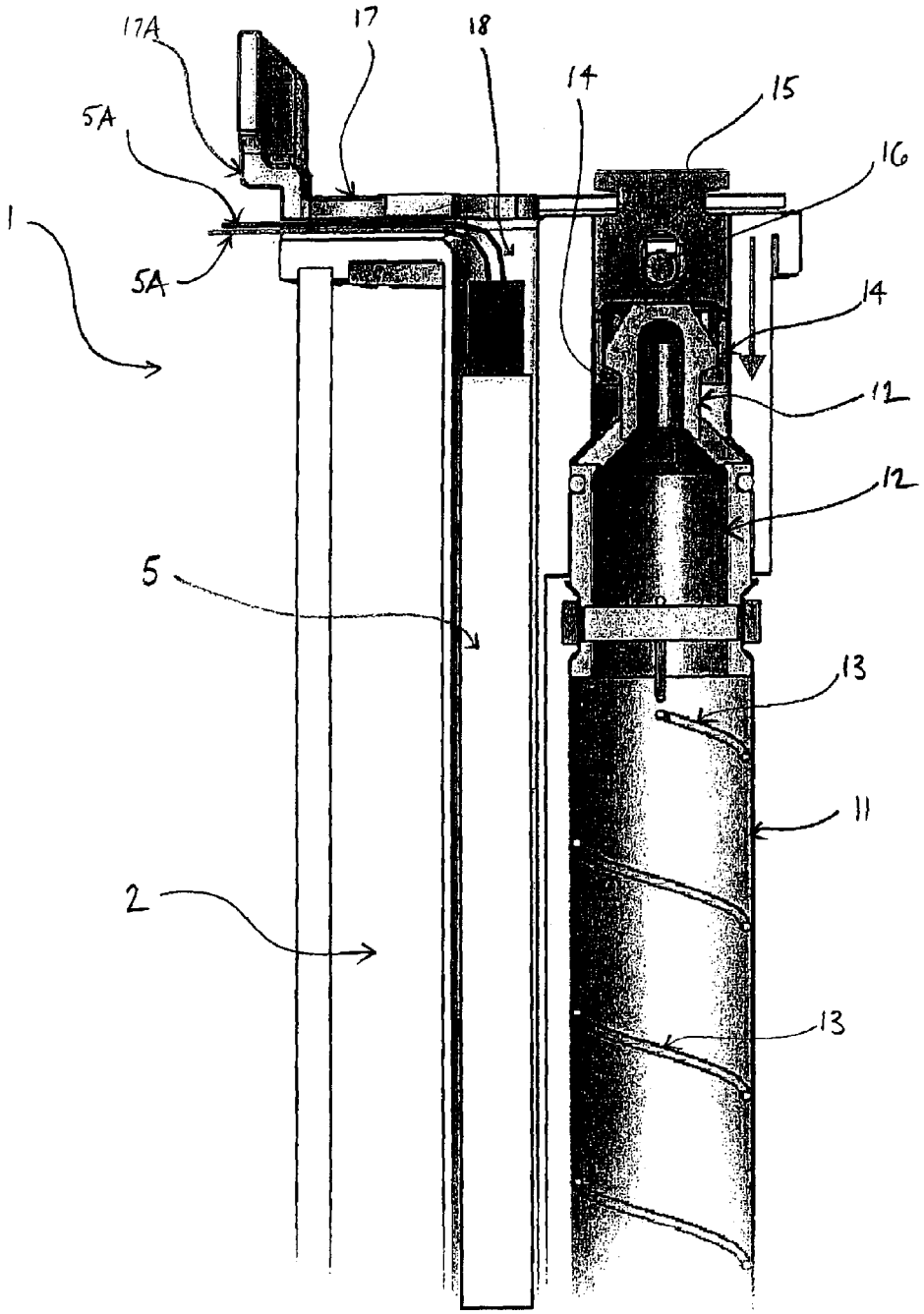

A support member in the form of a helical spring (13) is provided internal to the sheath (11). The helical spring (13) is anchored at its lower end to an internal wall of the cartridge (1). At its upper end the helical spring (13) is attached to the cap (12) that seals the sheath (11). The helical spring (13) supports the sheath (11) and in the embodiment shown the flexible membrane is in an extended position. In this position the deactivating agent is prevented from contacting the explosive composition. The cap (12) engages a release mechanism and this is more clearly illustrated in FIGS. 12-14.

FIGS. 12-15 show the cap (12) being gripped by a pair of retaining arms (14). These arms (14) are hinged towards their upper ends and themselves extend from a fitting (15). The cap (12) is configured to be gripped by the arms (14) and in the embodiment shown the cap (12) has shoulder portions under which the arms (14) are initially positioned. Towards its upper end the fitting (15) is in contact with a creep member (16) in the form of a plastic rod having known creep properties. In the extended position the helical spring (13) will exert a withdrawing forces against the creep member (16) through the cap/fitting (12, 15) assembly. Prior to use of the cartridge (1) this force is prevented from deforming the creep member (16) by a sliding member (17) that engages the upper end of the fitting such that downward movement of the fitting (15) and thus of the creep member (16) are prevented. In the extended position the arms (14) are prevented from splaying outwards about their hinges due to the configuration of adjacent internal wall portions of the cartridge (1).

Prior to use the sliding member (16) engages the fitting (15) and covers a detonator receiving passage (18) provided in the cartridge (1). When the cartridge (1) is used in the field the sliding member (17) is moved across to reveal the detonator receiving passage (18) allowing a detonator (5) to be inserted into the body of the cartridge (1). The detonator wires (5A) are guided and retained by wall portions (17A) provided on the sliding member (17). It will be appreciated that in the embodiment shown the detonator (5) cannot be inserted into the detonator receiving passage (18) until the sliding member (17) has been moved across from the position in which it engages the upper end of the fitting (15).

Figure 13:
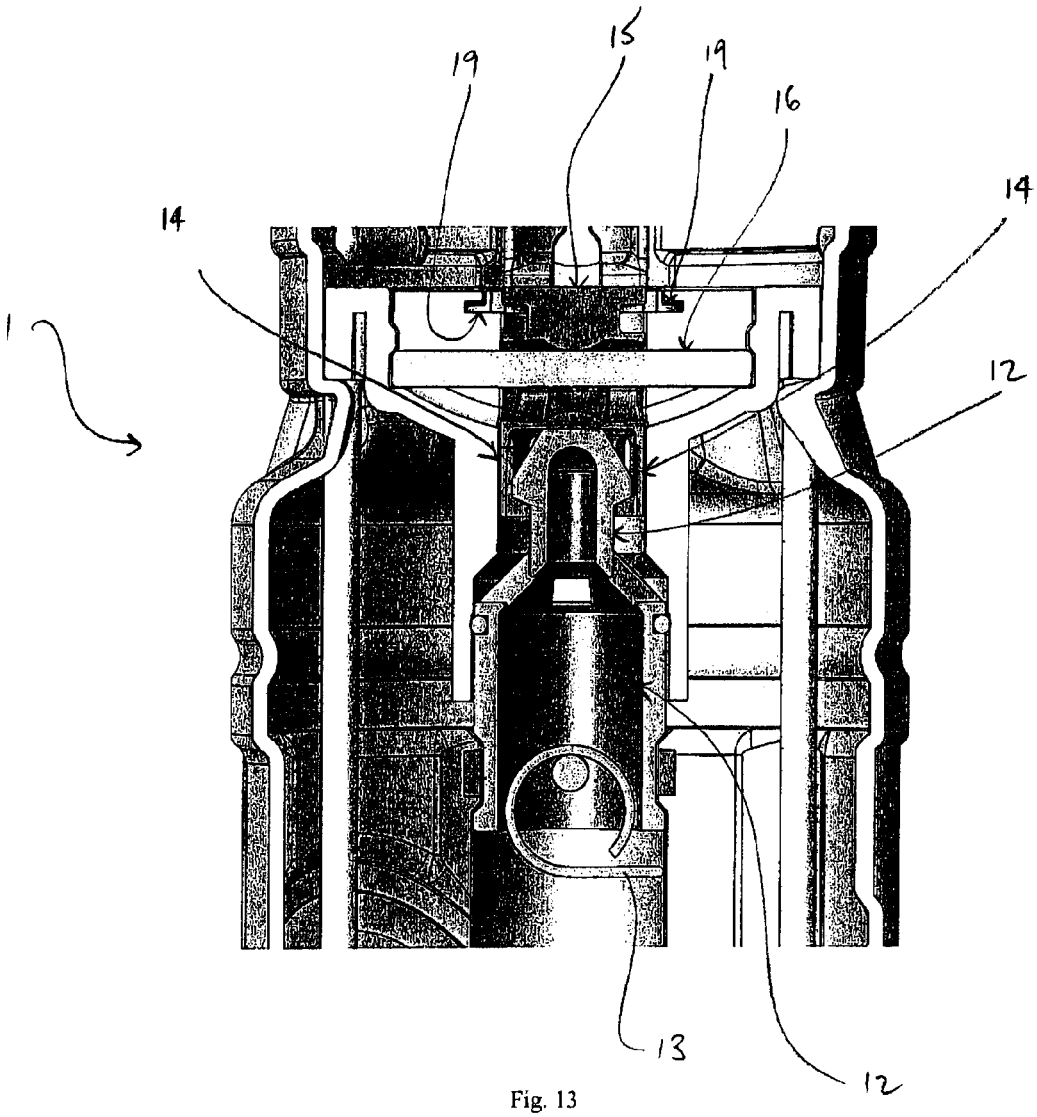
Figure 14:
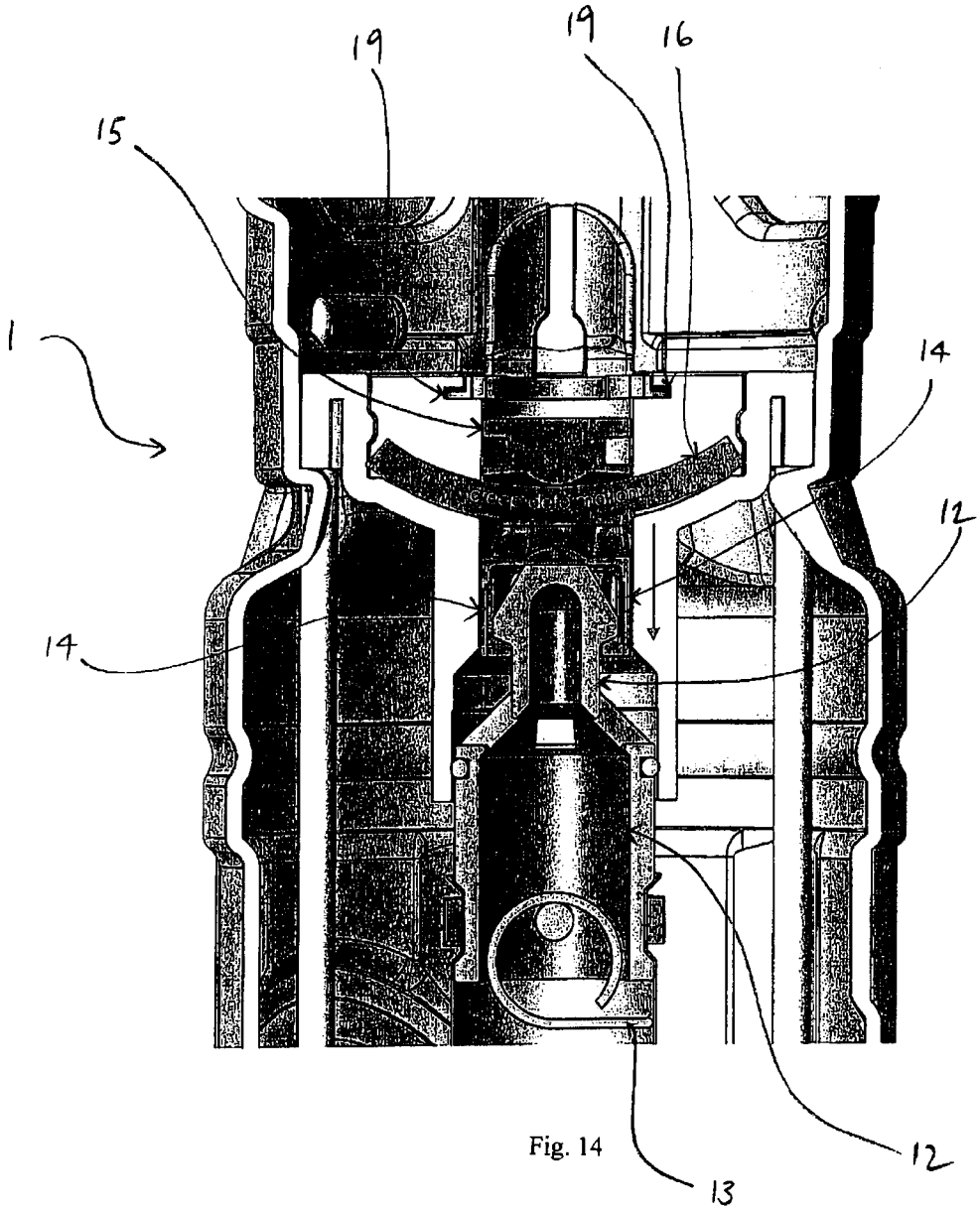
Figure 15:
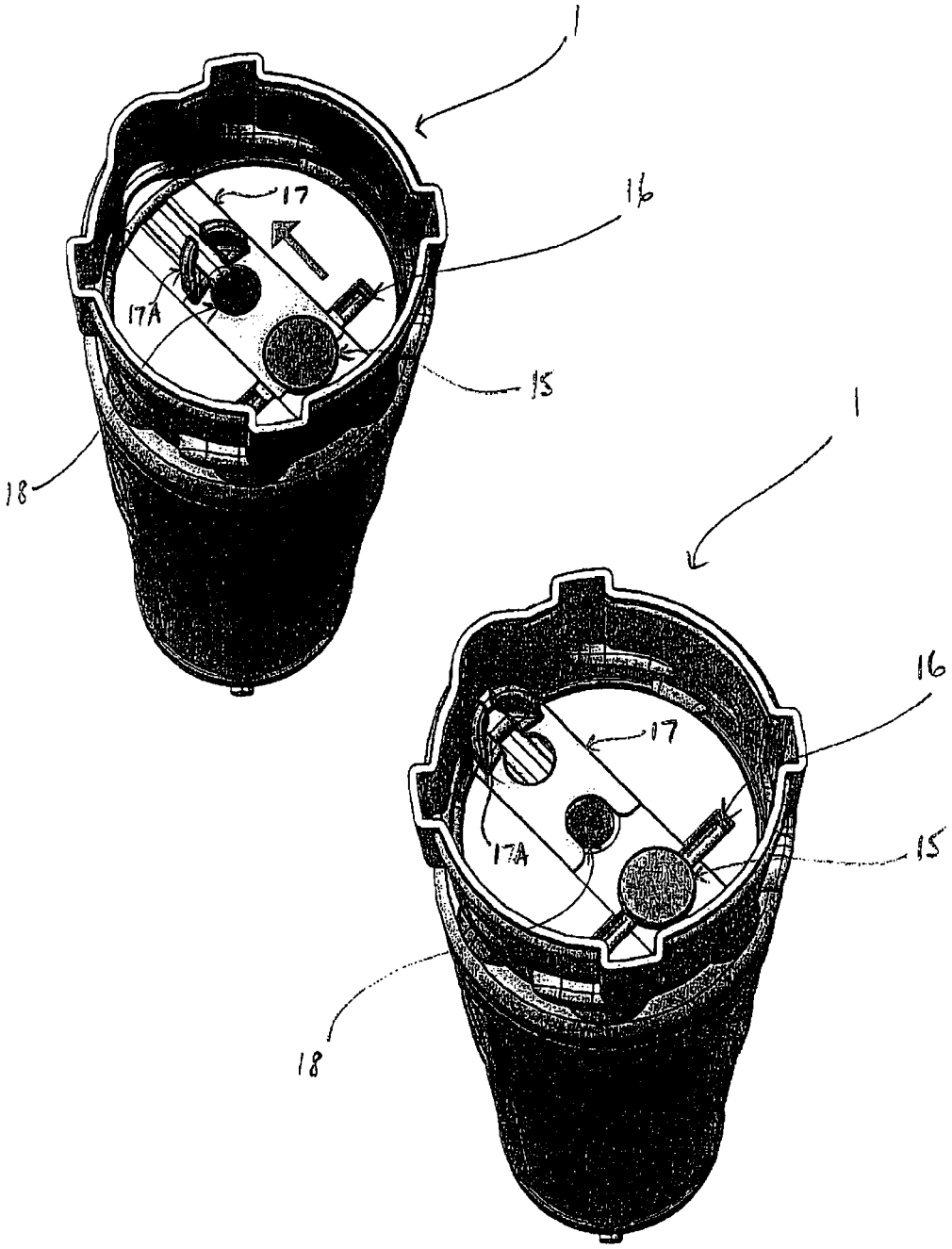

When the fitting (15) is no longer engaged by the sliding member (17) the withdrawing force exerted by the helical spring (13) will be communicated to the creep member (16). In turn this will initiate creep (and downward deflection) in the creep member (16). FIG. 13 shows the initial situation on release of the fitting (15) from engagement with the sliding member (17). The fitting (15) has been withdrawn slightly into the body of the cartridge (1) but further downward movement of it is prevented by suitably positioned retaining legs (19) provided on an internal wall of the cartridge (1). At this point the withdrawing force exerted by the helical spring (13) is experienced by the creep member (16). The creep member (16) will be deformed under load of the helical spring (13) causing deflection of the creep member (16). This is shown more clearly in FIG. 14.

Downward deflection of the creep member (16) will allow the cap/fitting (12,15) assembly to move downwards into the body of the cartridge (1). When the cap/fitting (12,15) assembly has travelled a predetermined distance the retaining arms (14) are allowed to splay out by virtue of shape of the relevant internal wall portions of the cartridge (1). The shoulders of the cap (12) have the effect of forcing the arms (14) outwardly but this movement is initially constrained by suitably shaped internal wall portions of the cartridge (1).

When the arms (14) are splayed out the fitting (15) no longer engages the cap (12) and the cap (12) is suddenly released. Residual tension in the helical spring (13) continues to act on the cap (12) however so it is withdrawn further into the body of the cartridge (1). As the helical spring (13) travels from its extended position to retracted position the sheath (11) will collapse forcing deactivating agent out through holes provided in the cap (12). The deactivation agent is then free to contact the explosive composition so that desensitisation is commenced.

Figure 16:
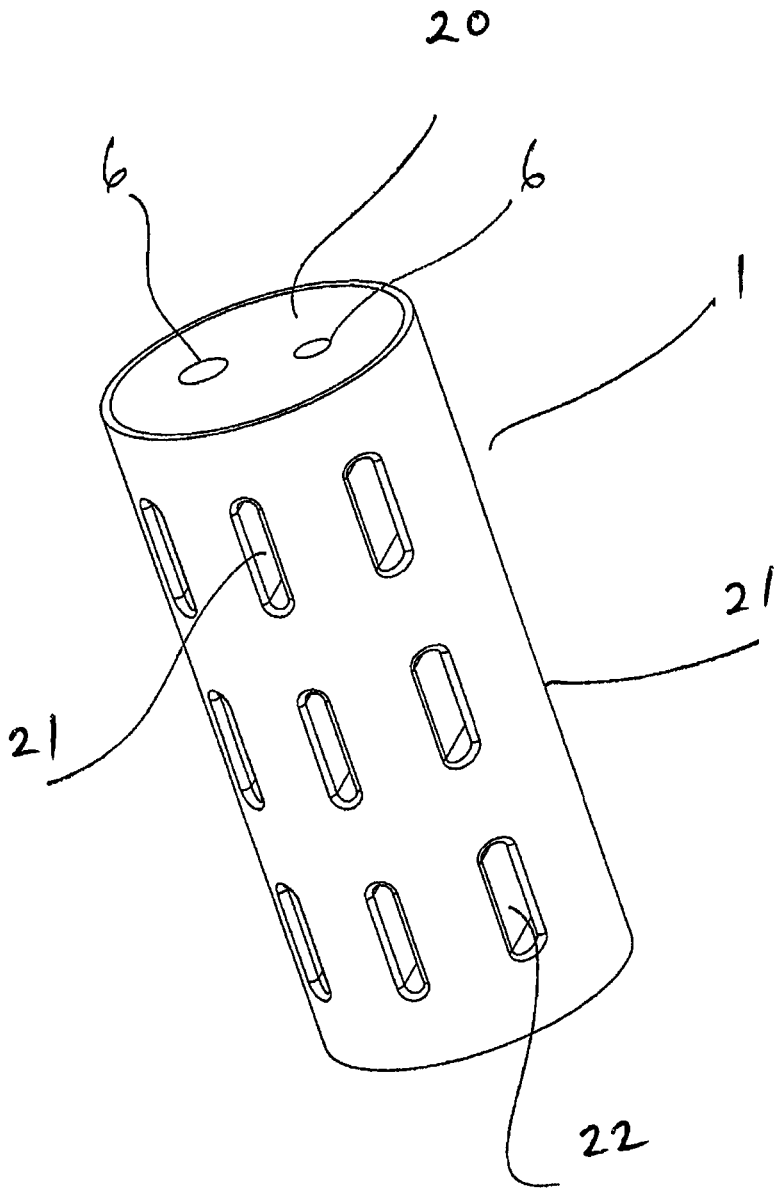
FIGS. 16 and 17 are perspective views of explosive cartridges in accordance with the present invention.
Figure 17:
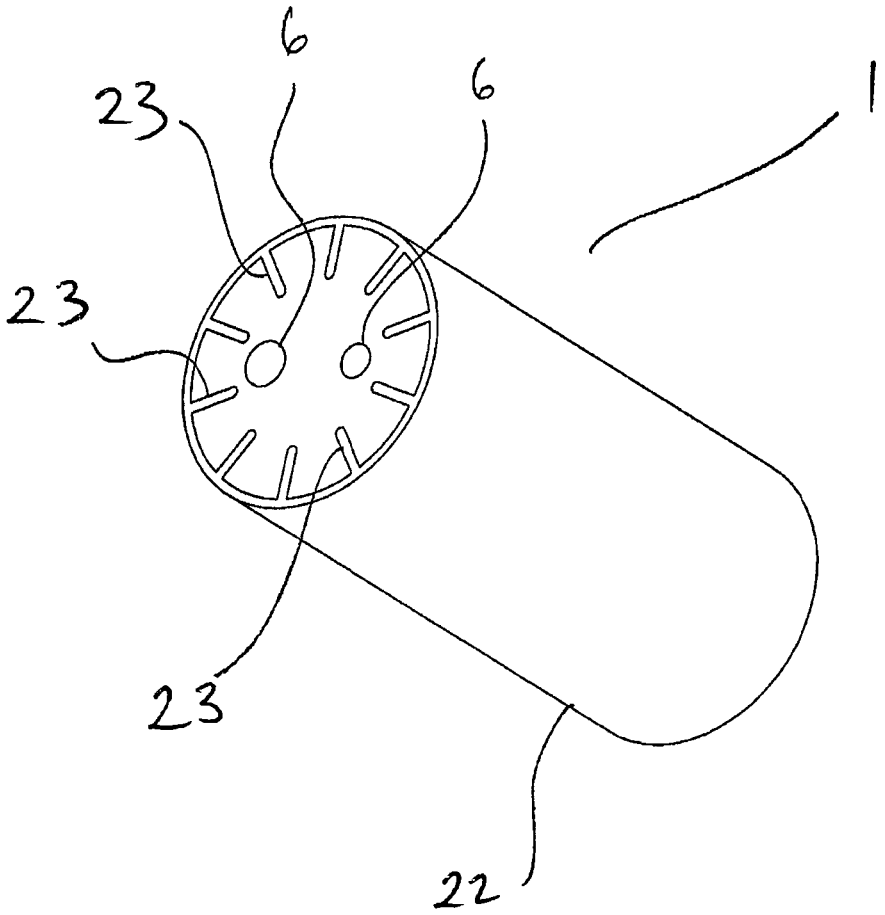

FIGS. 16 and 17 shows an explosive cartridge (1) useful in implementation of the invention. The cartridges (1) shown in these figures do not include a barrier element as required in accordance with the invention. The figures are nevertheless believed to be useful in illustrating embodiments of the present invention.

With respect to FIG. 16 the cartridge (1) includes explosive composition (20) which typically is in a solid (cast) form, such as Pentolite (typically a PETN/TNT and/or RDX mix). The explosive composition (20) includes detonator receiving channels (6) that enable the cartridge to be initiated by different sized (diameter) detonators. The cartridge (1) includes an outer shell (21) that is made of a water-permeable or water-degradable material. In the field environmental water may permeate or degrade the shell. The shell (21) also defines passages (22) extending into the explosive composition (20). The use of this configuration and type of shell allows environmental water to come into contact with the explosive composition (20), and is thus useful in embodiments of the invention where this is intended/required. The explosive composition (20) includes a chemical deactivating agent. For example, the chemical deactivating agent may be distributed throughout the explosive composition (20) in the form of pellets or granules. The pellets/granules may be mixed with the explosives composition (20) before the composition (20) is poured (cast) into the outer shell (21). Additionally or alternatively the chemical deactivating agent may be provided within the material making up the outer shell (12).

FIG. 17 shows another form of an explosive cartridge (1) useful in implementation of the invention. The cartridge (1) includes an explosive composition (20), such as a cast Pentolite explosive, surrounded by a shell (21). Chemical deactivating agent may be provided as described in relation to FIG. 1. The shell (21) is water-permeable or water-degradable, as for the shell discussed in FIG. 16. In FIG. 17 the shell (21) includes radial members (22) extending into the bulk of the explosive composition. The intention here is that when the cartridge (1) comes into contact with water, water dissolves the shell (21) so that water is then conveyed into contact with and through the explosive composition, as required by certain embodiments of the invention described herein. The rate at which the shell (21) dissolves may be controlled by suitable selection of material used to form the shell (21).

Figure 18:
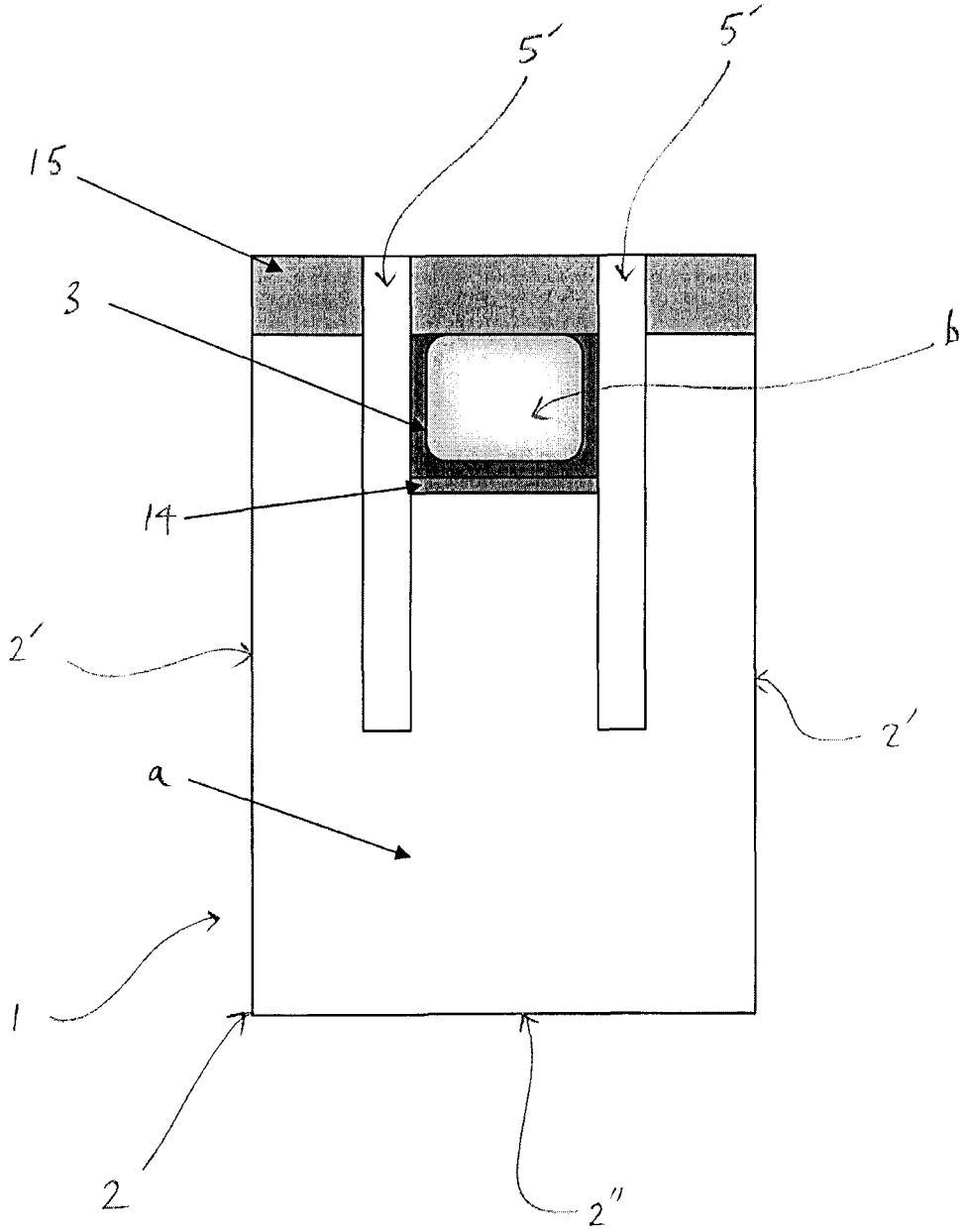
FIG. 18 is a cross-section of an explosive cartridge in accordance with the present invention.

FIG. 18 shows and explosive cartridge (1) suitable for use in seismic exploration. The cartridge (1) includes an explosive composition (a) and deactivating agent (b) in respective chambers (2,3). The chamber for the explosive composition (a) is in the form of a cylindrical shell comprising wall portions (2') sealed by a base (2"). The explosive composition (a) may be Pentolite, possibly in mixture with RDX and/or aluminium particles.

The explosive composition (a) and deactivating agent (b) are separated in their respective chambers by a base plate (14) that is loosely fitted at the lower end of the chamber (3) for the deactivating agent (b). The plate (14) may be formed of any suitable material such as a polyester or polycarbonate. The plate (14) may be provided with a double-sided adhesive to allow it to be positioned and retained in place—the purpose of the plate is to prevent contact between the deactivating agent (a) and explosive composition (b). That said, depending upon the nature of the deactivating agent and explosive composition it may be possible to dispense with the plate (14) altogether.

The cartridge (1) also includes two detonator receiving channels (5') extending into the explosive composition (a). The cartridge (1) also includes a cap (15) at one end. This cap (15) is sized and shaped to fit, for example by interference fit, into the shell housing the explosive composition.

Figure 19:
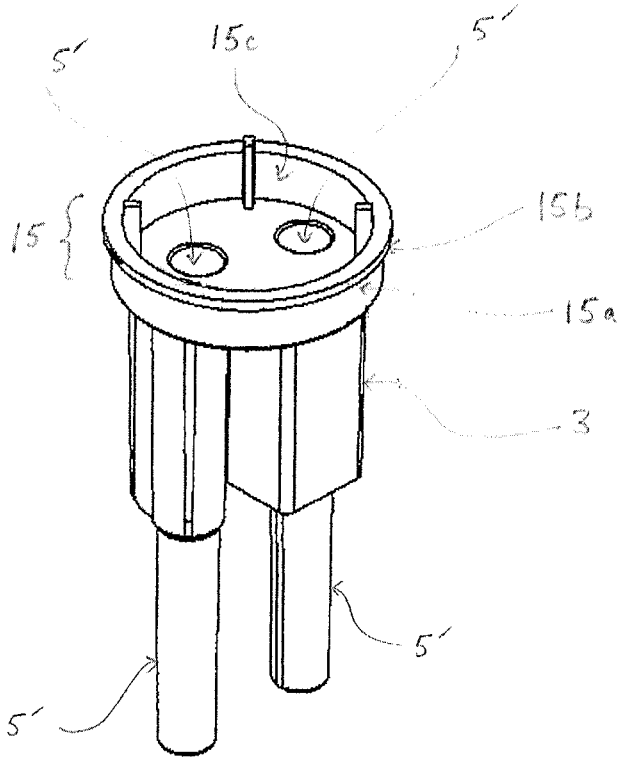
FIGS. 19 and 20 are perspective views showing a component of the explosives cartridge depicted in FIG. 18.
Figure 20:
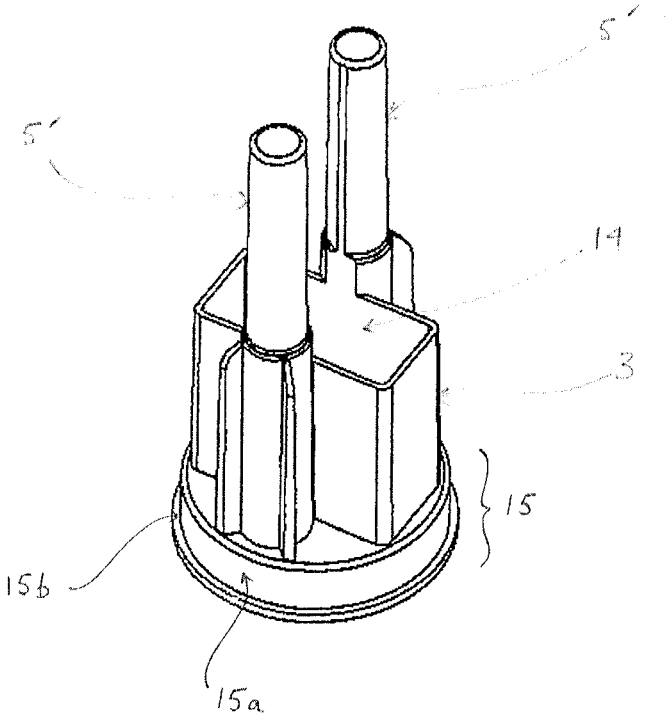

In practice the cartridge (1) may be provided as separate components that are assembled during loading of respective components and when used in the field. With respect to FIG. 6, one component may be integrally formed (by injection moulding of a plastics material) to include and define, the cap (15), the detonator receiving channels (5') and the chamber (3) for the deactivating agent (b) as illustrated in FIGS. 19 and 20. The base plate (14) and chamber/shell (2) for the explosive composition (a) are separate components. The chamber (2) is made up of a cylindrical tube comprising wall portions (2') and a base (2") that is attached at a lower end of the tube thereby sealing it.

FIGS. 19 and 20 illustrate certain components shown in FIG. 18. Thus, FIGS. 19 and 20 show the cap (15), detonating receiving channels (5') and chamber (3) for the deactivating agent formed as a one-piece construction, for example by injection moulding of a suitable plastics material. The chamber (3) for the deactivating agent is sealed by a separate plate (14). The cap (15) comprises a circular wall portion (15*a*) with a lip (15*b*) that enables the cap (15) to be secured (by interference fit) into a suitably sized and shaped chamber in which an explosive composition is provided (not shown in FIGS. 19 and 20). The cap (15) is typically inserted into a tube forming. The wall portions (2') extend above and below the cap (15) once inserted and are adapted to allow attachment of other cartridges or a nose cone, for example by thread fitting. The internal surface of the wall portion (2') may include a lug or tab to engage the lip (15*b*) so as to maintain the cap (15) in position. The upper end of the cap (15) is open to allow for insertion of at least one detonator into respective detonator receiving channels (5'). The end of the cap (15*c*) may be sealed with a suitably sized and shaped lid (not shown) or be formed in an injection moulding process. The cap (15) and/or wall portions (2') may include apertures to allow water to enter the explosive cartridge. As noted the wall portion (2') extending above the position of the cap (15) may receive the lower end of another explosive cartridge to form a train of cartridges. In this regard a surface (15*c*) of the wall portion (2') may be threaded to mate with corresponding threads provided on the outer surface and at the base of another cartridge. Cartridges may also be coupled by interference fit or by clip fasteners. The cap (15) may include apertures or grooves (not shown) in the side wall thereof extending through the circular wall portion (15*a*) and lip (15*b*) through which detonator leads may be passed after a detonator loading.

Figure 8:
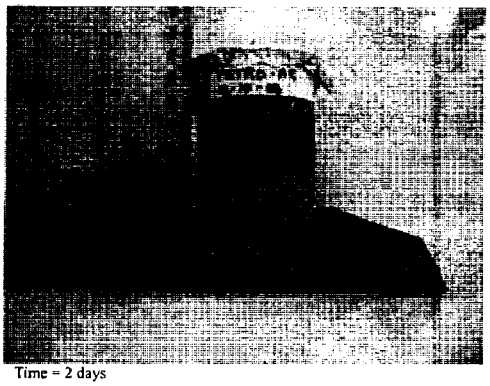

The embodiment illustrated in FIGS. 18-20 may be implemented as follows. In the orientation shown in FIG. 8 the plate (14) is removed and deactivating agent inserted into the chamber (3). The plate (14) is then replaced thereby sealing the chamber (3). The seal is loose in the sense that the chamber (3) is not liquid tight. Still in the orientation shown in FIG. 20, a cylindrical tube defining the wall portions (2') of the chamber (2) for the explosive composition (a) is inserted over the cap (15) with the cap (15) being retained in place by interference fit between the wall portion (2') and cap lip (15*b*).

An explosive composition, such as Pentolite, can then be poured into the open end of the tube, thereby surrounding the chamber (3) and detonator receiving channels (5'). If Pentolite is used it is cast above its melting point and allowed to solidify. Solidification may result in the formation of cracks and fissures extending through the bulk of the explosive composition. This may be desirable as such cracks and fissures allow water to travel through the explosive composition, as may be desired. Once the tube has been suitably filled with explosive composition, and the composition solidified as might be necessary, a base (2") is attached to the open end of the tube. The base (2") and wall portions (2') may form a seal by interference fit, male-female screw threading or by clip fastening.

In use the component so-formed is loaded with one or more detonators with the detonator leads being passed out of the cap (15) or upper part of wall portions (2') as noted. The top end of the cap (15) may itself be sealed using a lid made of water-degradable material (not shown).

One or more components of the cartridge may be water-degradable, and the degradability may be selective in order to provide enhanced control with respect to intended deactivation of the explosive composition.

In the embodiment described it is intended that the deactivating agent is rendered mobile by water entering the chamber (3) around the edges of the plate (14). The plate may be water-degradable. Additionally or alternatively the plate may include apertures to allow water entry into the chamber (3). Additionally or alternatively, the wall portions of the chamber (3) may also be water-degradable and/or include structures to allow water to enter the chamber (3) (the chamber (3) may itself be made of water-degradable material to facilitate water ingress). Water mobilises the deactivating agent and the mobilised deactivating agent may exit the chamber (3) for contact with explosive composition via the same (or different) route through which water entered the chamber (3).

Water may find its way into the chamber (3) in one or a combination of more than one way, as follows.

Where respective components are joined together, for example the wall portions (2') forming the chamber (2) and the cap (15) or the wall portions (2') and base (2"), the joint may allow water ingress. In this case water would enter the chamber (3) around the plate (14) by migration through the bulk of the explosive composition. The composition must therefore allow water transport by the presence of artificial and/or intrinsic water transport structures.

Additionally or alternatively, water may enter the explosive composition through the walls (2') and/or base (2") of the chamber (2). One or both of these components may include channels/apertures to allow water entry and/or one or both may be water-permeable or water-degradable. The exact configuration will depend upon the form of, and thus the containment needs, of the explosive composition.

Additionally or alternatively, water may enter the chamber (3) via the cap (15). Thus, the cap (15) may include channels/apertures extending through the cap (15) and into the chamber (3), for example through an aperture between the inner surface (15*c*) and the chamber (3). The aperture may itself be sealed by a water-degradable material. Water may enter the cap (15) through loose fitting seals (between the cap (15) and cap lid or between the wall portion (2') and an adjacent cartridge when a train of multiple cartridges is assembled). The apertures/grooves for the detonator leads may also allow water to enter the cap. Apertures/grooves in the upper part of the wall portions (2') may also allow water ingress.

Irrespective of the way in which water enters the chamber (3), when the deactivating agent is mobilised it will exit the chamber (3) and contact the explosive composition, thereby commencing deactivation of the explosive composition.

The material making up the shell (21), passages (22) and/or radial members (23) may be formed of a material that may be degraded by the action of microorganisms. As the shell (21) is degraded this allows water present in the environment to contact the chemical deactivating agent provided in the explosive composition (20) or shell (21). In turn this renders the chemical deactivating agent suitably mobile and/or active so that the chemical deactivating agent can commence desensitisation of the explosive composition. The microorganisms may also have the effect of acting on the explosive composition to convert it into less detonable or non-detonable by-products and/or by-products that are more environmentally friendly.

Embodiments of the present invention are now illustrated in the following non-limiting examples.

EXAMPLE 1

This example was undertaken to assess the effect as deactivating agent of a number of different reagents. The reagents selected for initial screening were chosen based on a general knowledge of emulsion chemistry and of reagents that had caused unwanted crystallisation of emulsion explosive compositions. All reagents were used as liquids and can be categorised as water soluble, oil soluble or polar organic. Water was used as a control liquid. The following table details the various liquids used in this experiment.

TABLE 1

| Class | Material | Details |
|---|---|---|
| Water soluble | Water (test control) | |
| | Ferric chloride | 42% solution |
| | Ferrous sulphate | 10% solution |
| | Magnesium nitrate | 10% solution |
| | Teric GN8 detergent | 10% solution |
| | Petro AG Special Liquid | 50% solution in water |
| Oil soluble | Propar 32 paraffin oil (test control) | |
| | Galoryl 626 | 10% solution in Propar 32 |
| | Galoryl 640 | 10% solution in Propar 32 |
| Polar organic liquids | Ethane-1,2-diol | Pure liquid |
| | Polyethylene glycol 600 | Pure liquid |
| | Propan-1,2-diol | Pure liquid |
| | Propan-2-ol | Pure liquid |
| | iso-Amyl alcohol | Pure liquid |
| | n-Hexylamine | Pure liquid |
| | Cyclo-Hexylamine | Pure liquid |
| | Octylamine | Pure liquid |
| | Acetone | Pure liquid |

Teric GN8 is a 10% solution of nonylphenol ethoxylate oligomer with 8 ethoxylate units, commercially available from Orica.

Petro AG Special Liquid is a 50% solution of sodium alkylnaphthalene sulphonate, commercially available from Akzo Nobel.

The screening test involved providing a 20 ml layer of the reagent under test on top of 30 g of a typical emulsion explosive composition provided in a 100 ml glass beaker. The composition of the emulsion explosive composition is given in Table 2 below.

TABLE 2

| Component | wt. % |
|---|---|
| Ammonium nitrate | 67.99 |
| Sodium nitrate | 3.01 |
| Sodium perchlorate | 10.45 |
| pH buffer | 0.34 |
| Water | 12.31 |
| Emulsifier* | 2.76 |
| Sorbitan mono-oleate | 0.56 |
| Paraffin oil | 2.58 |
| | 100.00 |

*Adduct of polyisobutylene succinic anhydride with diethanolamine, diluted to approximately 50% solution in paraffin oil.

Batches of the emulsion were prepared by as follows. Ingredients sufficient for a total emulsion mass of 3.0 kg were weighed out. Ammonium nitrate, sodium nitrate, sodium perchlorate (anhydrous), 30% lactic acid solution (neutralised to pH=4 with sodium carbonate) and water were heated and stirred in a water-jacketed tank to form a solution with a temperature of 90° C. In the bowl of a 3 speed Hobart model N-50 planetary mixer (water-jacketed and heated to 90° C.), the components, paraffin oil, sorbitan mono-oleate and PiBSA-DEA were stirred with a wire whisk attachment at Speed setting 2 to form an oil/emulsifier solution at 90° C. With the Hobart mixer stirring at Speed 2, the nitrate/perchlorate solution was added evenly to the oil/emulsifier solution over the course of 5 minutes, forming an emulsion of the water-in-oil type. The mixer speed was increased to Speed 3 for a further 5 minutes, giving a final emulsion product with viscosity 70,000 centipoise at 70° C. (as measured using a Brookfield RVT viscometer with spindle 1 at 50 rpm).

Figure 4:
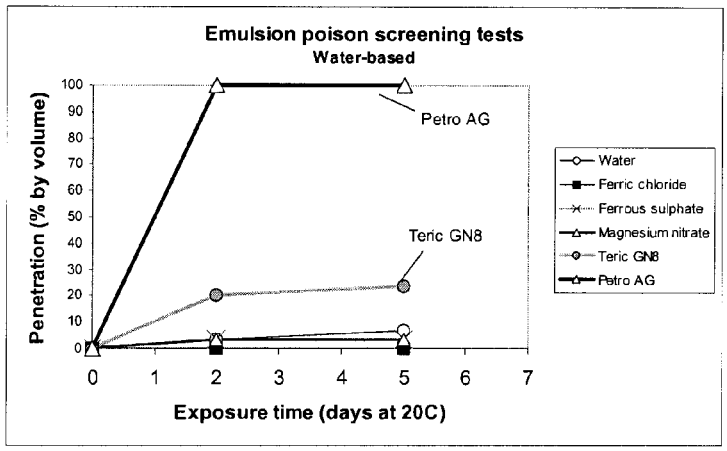
FIGS. 4-6 are graphs illustrating experimental results obtained in certain examples described herein.

After the layer of reagent was provided on top of the emulsion explosive composition the condition of the emulsion was monitored. Reagents were rated according to how fast they penetrated and damaged the emulsion. This was assessed based on visual colour and texture changes of the emulsion and this was taken as being representative of the degree of crystallisation. The results for the water soluble, oil soluble and polar organic, liquids are illustrated in FIGS. 2, 3 and 4, respectively.

The chemistry of Petro AG Special Liquid is obviously important but reference to this, or any other, commercial product should not be regarded as limiting the present invention. Reference to commercial products in the present specification is intended to show that the invention may be implemented on the basis of existing products. Materials for use in practice of the invention may of course be prepared, rather than purchased, by the application or adaptation of known techniques.

EXAMPLE 2

While some of the polar organic liquids tested provided relatively rapid and effective penetration of the emulsion explosive composition, Petro AG Special Liquid was selected as the reagent with the best overall performance. Petro AG Special Liquid is a 50% strength solution of sodium alkyl naphthalene sulphonate in water and is commercially available from Akzo Nobel. This reagent is also useful in practice of the present invention from a number of other perspectives (it is water based non-flammable, has relatively low toxicity and odour, is non-volatile, may be manufactured in a non-hazardous and easy manner and is commercially available).

Figure 5:
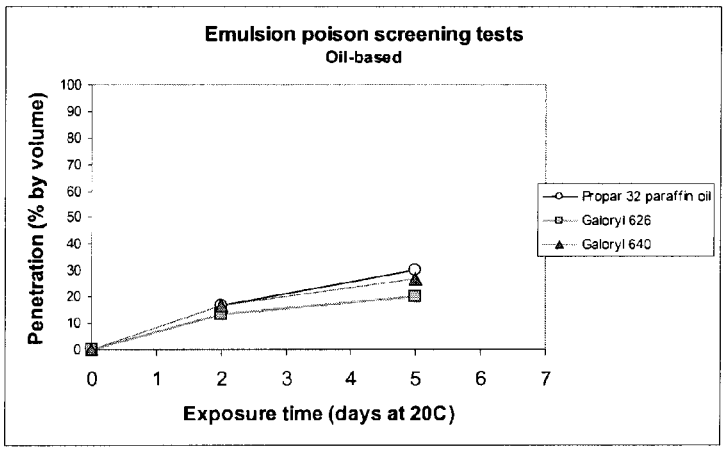
Figure 6:
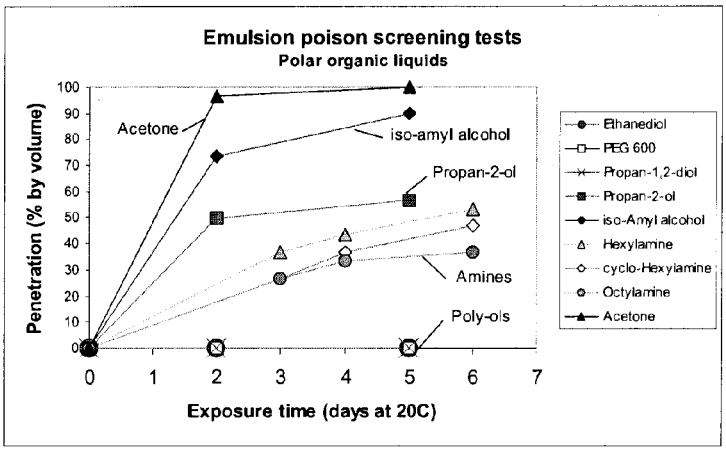

As further indication of the efficacy of the using Petro AG Special Liquid, FIGS. 5 and 6 are photographs showing the effect of Petro AG Special Liquid on an emulsion explosive composition of the type identified in Table 2. In FIG. 5 the layer of Petro AG Special Liquid has just been provided on top of the emulsion explosive composition. The layer of Petro AG Special Liquid appears as a darker layer provided over the top of the lighter emulsion explosive composition provided in the bottom of the beaker. From the scale included in the photograph it can be seen that the emulsion explosive composition initially was approximately 3 cm in depth and the Petro AG Special Liquid approximately 1.5 cm. FIG. 6 shows the same beaker after the Petro AG Special Liquid has been in contact with the emulsion explosive composition for a period of two days. The effect of the Petro AG Special Liquid is believed to be immediately apparent when one compares FIGS. 5 and 6 side-by-side. It will be noted that the "level" of emulsion composition has dropped by approximately 1 cm (effectively 33%). This shows that the Petro AG Special Liquid has had a significant impact on the integrity of the emulsion explosive composition.

Figure 7:
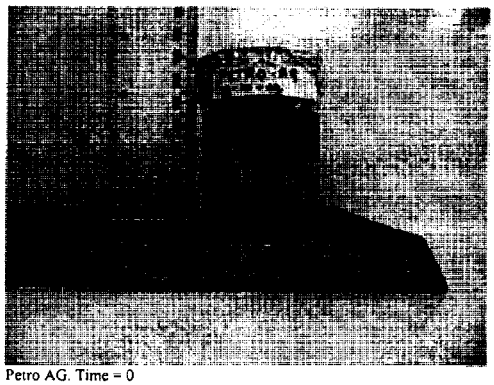
FIGS. 7-10, are photographs illustrating experimental results obtained in certain examples described herein.

For comparison, the experiment was repeated using a commercially available detergent (Teric GN8). The results are shown in FIG. 7 at the commencement of the test and FIG. 8 after five days. The Teric GN8 and the emulsion explosive composition are not of sufficiently different colours for the interface between the two to be seen clearly in FIGS. 7 and 8. However, a marker has been included on the outside surface of the beaker to show the position of the interface between the two. It is immediately apparent that, even after five days, the detergent has had little effect on the emulsion explosive composition. It is possible that the detergent causes some crystallisation at the interface with the emulsion explosive composition but it is evident that Petro AG Special Liquid causes massive crystallisation several centimeters away from the interface and within the body of the emulsion explosive composition. The exact mechanism by which this crystallisation occurs is not well understood but this is not material to the invention.

EXAMPLE 3

Figure 9:
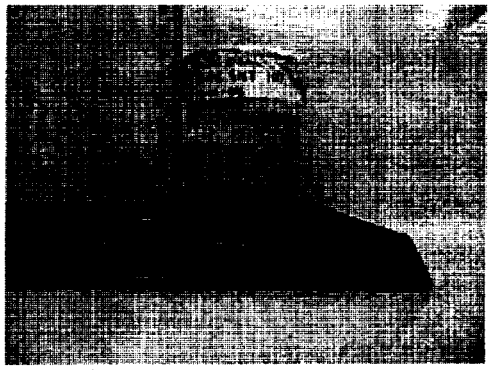

When actively mixed into an emulsion explosive composition (as per Table 2), as opposed to simple surface contact, about 3% by weight of Petro AG Special Liquid was required to cause enough crystallisation to render a 63 mm diameter charge insensitive to a No. 8 detonator. The relationship between the amount of reagent (deactivating agent) used, the degree of crystallisation and the detonation performance is shown in FIG. 9. This figure shows that 3% is the theoretical minimum amount of Petro AG Special Liquid that would need to available in a self-deactivating cartridge in accordance with the present invention.

EXAMPLE 4

In the proposed explosive cartridge in accordance with the present invention there is no active mixing of the deactivating agent and emulsion explosive composition. Indeed, there is only a static surface exposure of these two components. To examine whether this is sufficient to deactivate an emulsion explosive composition, paper-walled axial cavities (10 mm and 12 mm in diameter, respectively) were created inside 57 mm diameter emulsion charges. Each cavity was filled with Petro AG Special Liquid. Being porous, the paper allowed the Petro AG Special Liquid to instantly contact the emulsion explosive composition. This may be regarded as simulating the end of the period at which time a wall of material degradable by the deactivating agent loses its integrity and exposes the emulsion explosive composition to the deactivating agent. In this example the amount of Petro AG Special Liquid in a 10 mm cavity equates to 3% w/w of the charge while the 12 mm cavity equates to 5% w/w of the charge.

Figure 10:
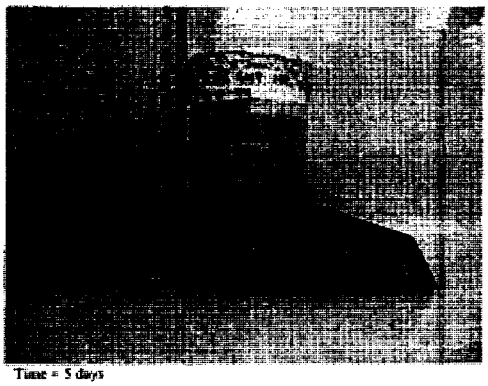

For both cavity sizes it was observed that crystallisation of the emulsion proceeded slowly radially outward from the axis of the cavity. The charges became highly crystallised and were found to be detonator-insensitive within one month, as confirmed by velocity-of-detonation (VOD) tests. The results are shown in FIG. 10. This figure also shows a control in which no cavity/deactivating agent was used.

EXAMPLE 5

500 ml water was heated to 45° C. in a water bath. Pentolite was added to 200 ppm (200 mg/L), consisting of 70 ppm PETN and 130 ppm TNT. Sodium hydroxide solution (0.004 M) was added in an amount of 0.2 ml from a stock solution of 10M. The resultant solution was then removed from the water bath and allowed to sit at room temperature (21° C.) overnight in the dark. Samples were taken and analysed for PETN and TNT levels. The experiment was repeated using water as control. The results are presented in Table 3 below.

TABLE 3

| | PETN (mg/L) | TNT (mg/L) |
|---|---|---|
| NaOH (0.004M) | 40 | 1.0 |
| Water | 45 | 110 |

Table 3 demonstrates the conversion of TNT by the action of the strong alkali sodium hydroxide. Surprisingly, little or no detectable activity is present on the PETN molecule. Conversion of TNT by alkali is well established in the art and is known to proceed via mechanisms including, but not limited to, chemical reduction of the nitrate groups and/or removal of the nitrate groups.

The action of alkali on TNT is well established in the art for destruction of TNT. It has, however, to the authors knowledge, never been incorporated into an explosive device for purposes including, but not limited to, rendering the device less prone to initiation and more amenable to biodegradation.

This demonstration of the conversion of TNT in a Pentolite solution confirms that an alkali can be used to enhance the degradation of explosive devices, including Pentolite based devices.

EXAMPLE 6

Iron Degradation Control

In this example, coated iron particles are used to demonstrate the effect of NaCl addition in enhancing the degradation of Pentolite, presumably by effecting either, degradation of the barrier or, 'de-passivation' of the iron particles. This example has broad application as iron particles may be maintained in a non-functional state until NaCl is released, thus initiating degradation of the Pentolite.

Experimental

Iron powder (Cat. no. 00631, Fluka, Australia) (150 mg) was added to 3 ml RNW buffer (1 mM KHCO3, 0.5 mM CaCl2, 0.206 mM MgSO4, 8.95 μM FeSO4, 0.25 mM HCl, pH ~7.8). To one set of iron containing tubes NaCl was added at 3 mM whilst a non-iron containing control was established with only RNW and 3 mM NaCl. The reaction commenced with the addition of Pentolite (acetone) solution to a final concentration of 100 ppm. Sacrificial sampling was performed for analysis after 1, 15 or 51 days' incubation at room temperature in the dark. Samples were processed for analysis by addition of 9 mL of acetonitrile and subsequently analysed by HPLC-UV using standard methods.

Results of analysis are shown in the following table, demonstrating control of iron degradation of Pentolite by the use of a corrosion enhancer. Degradation of Pentolite increases in a time-dependent manner and is initiated by the presence of a corrosion enhancer.

NaCl Mediated Degradation of Pentolite by Iron Powder

| Sample | Time (days) | PETN (mg/L) | TNT (mg/L) | PETN % degradation | TNT % degradation |
|---|---|---|---|---|---|
| Control RNW | 1 | 31.2 | 64 | 0% | 0% |
| | 15 | 33.2 | 68 | 0% | 0% |
| | 51 | 35.2 | 59.6 | 0% | 0% |
| Iron | 1 | 31.2 | 64 | 0% | 0% |
| | 15 | 52 | 68 | 0% | 0% |
| | 51 | 36 | 60 | 0% | 0% |
| Iron + NaCl | 1 | 31.2 | 64 | 0% | 0% |
| | 15 | 32 | 21.2 | 3.6% | 68.8% |
| | 51 | 15.2 | <0.4 | 56.8% | >97% |

EXAMPLE 7

Iron Degradation Control

A control mechanism to maintain iron in an 'inactive' state for a predetermined period (shelf-life) is of key relevance to it's successful application. This control mechanism can be provided by coating the iron in a degradable barrier, preferably a water soluble barrier.

Experimental

Iron powder (Cat. no. 12311—Reidel-deHaen, Australia) (30 mg) was added to two sets of tubes and Pentolite stock solution was added directly to the iron powder and the acetone allowed to evaporate (dry). Alternatively, iron was added to RNW buffer (1 mM $KHCO_3$, 0.5 mM $CaCl_2$, 0.206 mM $MgSO_4$, 8.95 μM $FeSO_4$, 0.25 mM HCl, pH ~7.8) to make 100 ppm Pentolite solution and thus suspending the iron powder (wet). Control tubes contained Pentolite stock solution only. Tubes were sacrificed for analysis after 3 days and 10 days incubation at room temperature in the dark. Samples were processed for analysis by addition of 9 mL of acetonitrile and subsequently analysed by HPLC-UV using standard methods.

Results are shown in the following table, demonstrating control of iron degradation of Pentolite. Degradation of Pentolite was accompanied by corrosion of the iron powder with an orange oxide layer forming above the grey iron powder.

Degradation of Pentolite by Iron Wet Form, but Not Dry Form

| Sample | Time (days) | PETN (mg/L) | TNT (mg/L) | PETN degradation | TNT degradation |
|---|---|---|---|---|---|
| Control | 3 | 35.2 | 72.4 | 0% | 0% |
| | 10 | 33.6 | 60.8 | 0% | 0% |
| Dry iron | 3 | 37.6 | 77.2 | 0% | 0% |
| | 10 | 34.8 | 65.2 | 0% | 0% |
| Wet iron | 3 | 2.8 | 0.4 | 92% | 99% |
| | 10 | 1.2 | <0.4 | 96% | >99% |

EXAMPLE 8

Degradation of PETN (SPC)

Sodium percarbonate (SPC) has been used in the present example as it is a stable solid complex of Sodium Carbonate and Hydrogen Peroxide. This compound thus combines oxidative power, which, once exhausted, leaves an alkaline environment to degrade alkali sensitive compounds eg. TNT. In addition to these 'simple' reactions, peroxide can establish catalytic cascades, particularly, but not exclusively, in the presence of metals (eg. Iron).

Experimental

Sodium Percabonate (SPC) was purchased from Sigma-Aldrich, Australia (Cat #371432) and solutions, once prepared, were used immediately. A 100 mM SPC solution was made in RNW buffer, which is a water-based buffer exhibiting moderate general hardness and alkalinity (1 mM $KHCO_3$, 0.5 mM $CaCl_2$, 0.206 mM $MgSO_4$, 8.95 μM $FeSO_4$, 0.25 mM HCl, pH ~7.8). Two ten-fold serial dilutions were made of this solution into the same buffer, representing 10 mM and 1 mM SPC. A Pentolite (acetone) solution was added to 200 ppm in a volume of 3 mL per reaction and incubated at room temperature overnight in the dark. Samples were sacrificed by addition of 9 mL acetonitrile and TNT/PETN were analysed by HPLC-UV using standard methods.

Degradation of Pentolite by Sodium Percarbonate

| Sample | PETN (mg/L) | TNT (mg/L) | PETN % degradation | TNT % degradation |
|---|---|---|---|---|
| Control | 59.2 | 119.6 | 0% | 0% |
| 1 mM SPC | 57.6 | 102.8 | 2.7% | 14% |
| 10 mM SPC | 53.6 | 2.8 | 9.5% | 97.7% |
| 100 mM SPC | 10 | <0.4 | 83.1% | >99.7% |

The reference to any prior art in this specification is not, and should not be taken as, an acknowledgment or any form of suggestion that prior art forms part of the common general knowledge in Australia.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. An explosive cartridge that is self-deactivating if detonation does not take place as intended, the explosive cartridge comprising:

an outer shell surrounding an explosive composition;

a deactivating agent that is capable of desensitising the explosive composition and that is provided in a form that is rendered mobile on contact with water; and a barrier element that is provided between and prevents contact between the explosive composition and the deactivating agent, wherein the cartridge is adapted to allow water from the environment to enter, or be delivered into, the cartridge and come into contact with the deactivating agent, thereby rendering the deactivating agent mobile, wherein the barrier element is adapted to be breached or at least partially removed when the deactivating agent has been rendered mobile by contact with water from the environment that enters or is delivered into the cartridge so that the deactivating agent will come into contact with the explosive composition, and wherein when mobile the deactivating agent will contact the explosive composition and will render the explosive composition insensitive to detonation after a predetermined period of time by which detonation of the explosive cartridge should have occurred but has not occurred.

2. An explosive cartridge according to claim 1, wherein the outer shell comprises passages extending radially into the explosive composition and being made of a water-permeable or water-degradable material to allow water to enter the cartridge when used.

3. An explosive cartridge according to claim 1, wherein the cartridge comprises an inlet, a water-degradable pathway or a water permeable pathway that allows water from the environment to enter, or be delivered into, the cartridge and come into contact with the deactivating agent thereby rendering the deactivating agent mobile.

4. An explosive cartridge according to claim 1, wherein the outer shell is formed of a material that is degraded by the action of microorganisms and wherein as the shell is degraded by microorganisms water from the environment is allowed to enter, or be delivered into, the cartridge and come into contact with the deactivating agent thereby rendering the deactivating agent mobile.

5. An explosive cartridge according to claim 1, wherein the deactivating agent is provided in dehydrated form or dried form such that contact with water results in formation of a mobile solution or mobile suspension of the deactivating agent.

6. An explosive composition according to claim 1, wherein the deactivating agent is provided as a gel or viscous liquid that becomes mobile when contacted with water.

7. An explosive composition according to claim 1, wherein the predetermined period of time is from 3 to 6 months.

8. An explosive composition according to claim 1, wherein the predetermined period of time is 12 months.

9. An explosive cartridge according to claim 1, wherein the deactivating agent is provided in a chamber in the explosive cartridge and the barrier element takes the form of a plate that provides a seal to the chamber and prevents contact between the explosive composition and the deactivating agent.

10. An explosive cartridge according to claim 9, wherein the seal is not liquid tight, wherein the deactivating agent is rendered mobile by water that enters the chamber and wherein when mobile the seal allows the deactivating agent to exit the chamber and contact the explosive composition.

11. An explosive cartridge according to claim 9, wherein the plate is water-degradable.

12. An explosive cartridge according to claim 9, wherein the plate includes apertures.

13. A method of blasting using an explosive cartridge that is self-deactivating if detonation of the explosive cartridge does not take place as intended, which method comprises:

(a) providing an explosive cartridge according to claim 1;

(b) positioning the explosive cartridge in a borehole;

(c) allowing water from the environment to enter, or be delivered into, the explosive cartridge and come into contact with deactivating agent in the explosive cartridge thereby rendering the deactivating agent mobile so that the deactivating agent will contact the explosive composition and render the explosive composition insensitive to detonation after a predetermined period of time by which detonation of the explosive cartridge should have occurred but has not occurred.

* * * * *